US009469110B1

(12) United States Patent
Kaneko

(10) Patent No.: US 9,469,110 B1
(45) Date of Patent: Oct. 18, 2016

(54) LIQUID EJECTING HEAD AND LIQUID EJECTING APPARATUS

(71) Applicant: SEIKO EPSON CORPORATION, Tokyo (JP)

(72) Inventor: Tomoshige Kaneko, Minowa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/059,952

(22) Filed: Mar. 3, 2016

(30) Foreign Application Priority Data

Mar. 23, 2015 (JP) ..... 2015-058944

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2/162; B41J 2002/14475; B41J 2/145; B41J 2/15; B41J 2/155
See application file for complete search history.

(56) References Cited

U.S. PATENT DOCUMENTS

2008/0291245 A1* 11/2008 Takei ..... B41J 2/1433 347/47
2010/0103222 A1* 4/2010 Park ..... B41J 2/14233 347/47
2013/0162719 A1* 6/2013 Akahane ..... B41J 2/1433 347/47

FOREIGN PATENT DOCUMENTS

JP 2005-246832 9/2005
JP 2008-213272 9/2008

* cited by examiner

*Primary Examiner* — Kristal Feggins
(74) *Attorney, Agent, or Firm* — Workman Nydegger

(57) ABSTRACT

A liquid ejecting head includes: an ejection surface along which a plurality of nozzles that eject ink are arranged; and a projection portion which has a long shape on the ejection surface, and protrudes toward the ejection surface, in which the projection portion includes a part in which the height varies from one end side to the other end side, in which the width of the projection portion becomes narrower from a base side to a tip end side in the direction of height, and in which the shapes of end portions of the projection portions on one end side and the other end side are different from each other. Accordingly, even when a medium transported opposing the ejection surface is curled, it is possible to prevent the medium from floating up by the projection portion, and thus, it is possible to prevent the medium from coming into contact with the ejection surface by a simple configuration.

20 Claims, 16 Drawing Sheets

40
42a
43a
262
Ga
44
45
45a
45b
45c
Gb
42b
43b 40
42a
43a
262
Ga
44
45c
45b
45a
45
Gb
42b
43b 40
42a
43a
262
Ga
44
45
Gb
42b
43b 40
42a
43a
262
Ga
44
45
Gb
42b
43b

LIQUID EJECTING HEAD AND LIQUID EJECTING APPARATUS

BACKGROUND

The entire disclosure of Japanese Patent Application No: 2015-058944, filed Mar. 23, 2015 is expressly incorporated by reference herein in its entirety.

1. Technical Field

The present invention relates to a technology for ejecting liquid, such as ink.

2. Related Art

In a liquid ejecting apparatus, such as an ink jet printer, liquid, such as ink, is ejected toward a medium, such as printing paper, from a liquid ejecting head. There is a case where the paper is transported while being curled due to drying, or the paper is curled while being swollen by the ink. For example, in JP-A-2008-213272, a technology in which a hole is formed between nozzles on a discharge surface provided with the nozzles that discharge ink, and a suppressing member that suppresses paper is provided so as to be freely driven to be projected from the hole, is disclosed. According to this, when the paper is transported to the discharge surface, the paper is prevented from floating up by driving the suppressing member to protrude from the hole on the ejection surface.

However, in order to make the suppressing member be freely driven so as to project from the discharge surface as described in JP-A-2008-213272, it is necessary to provide a driving element which drives the suppressing member, and a circuit which drives the driving element, and the structure becomes complicated. However, since the paper is suppressed only at a position where the suppressing member is provided, the contact with the discharge surface cannot be suppressed due to the curled state of the paper. For example, there is also a case where a tip end of the paper is transported while being curled from the beginning. In this case, there is a concern that, before the paper is transported to a position where the suppressing member is projected, the tip end of the paper comes into contact with the discharge surface, and the ink remaining on the ejection surface adheres to the paper. In consideration of the above-described situation, the invention accurately prevents a medium from coming into contact with an ejection surface provided with nozzles that eject liquid by a simple configuration.

SUMMARY

Aspect 1

According to a preferable example (Aspect 1) of the invention, there is provided a liquid ejecting head including: an ejection surface along which a plurality of nozzles that eject liquid are arranged in a first direction; and a projection portion which has a long shape in a second direction that intersects with the first direction on the ejection surface, and protrudes toward a side to which the liquid is emitted from the ejection surface, in which the projection portion includes a part in which the height varies from one end side to the other end side in the second direction, in which the width of the projection portion becomes narrower from a base side to a tip end side in the direction of height, and in which the shapes of end portions of the projection portions on one end side and the other end side are different from each other in the second direction. In Aspect 1, the long projection portion which extends in the second direction that intersects with the first direction, and protrudes toward the side to which the liquid is emitted from the ejection surface, is provided on the ejection surface along which the plurality of nozzles that eject the liquid are arranged in a first direction. For this reason, even when the medium which is transported opposing the ejection surface is curled, it is possible to prevent the medium from floating up by the projection portion. In this manner, it is possible to prevent the medium from coming into contact with the ejection surface by a simple configuration in which the projection portion is provided on the ejection surface. Accordingly, it is possible to prevent the liquid remaining on the ejection surface from adhering to the medium.

In Aspect 1, the projection portion includes a part in which the height varies from one end side to the other end side in the second direction, the width of the projection portion becomes narrower from the base side to the tip end side in the direction of height, and the shapes of the end portions of the projection portions on one end side and the other end side are different from each other in the second direction. For this reason, the position, the number, or the area in which the projection portion and the medium come into contact with each other changes from one end side to the other end side. Accordingly, it is possible to prevent the tip end of the medium which comes into contact with the projection portion from being damaged, and to suppress frictional resistance between the projection portion and the medium. Therefore, it is possible to suppress deterioration of the transporting speed of the medium. In addition, in Aspect 1, since the width of the projection portion becomes narrower from the base side to the tip end side in the direction of height, compared to a case where the width of the projection portion does not change from the base side to the tip end side in the direction of height, a space widens in the direction of height of the projection portion. For this reason, it is possible to make it difficult for an airflow which is generated as the liquid is ejected, such as a vortex, to remain on the ejection surface. In this manner, it is possible to improve the printing quality by making it difficult for the ejected liquid to be influenced by the airflow.

Aspect 2

In a preferable example (Aspect 2) of Aspect 1, the height of the projection portion may gradually become higher from one end side to the highest part in the second direction, and be constant from the highest part to the other end side. In Aspect 2, since the height of the projection portion gradually becomes higher from one end side to the highest part in the second direction, it is possible to reduce an entry angle of the tip end of the medium with respect to the projection portion when the tip end of the medium comes into contact with one end side of the projection portion. For this reason, it is possible to prevent the tip end of the medium from being damaged. In addition, in Aspect 2, since the height of the projection portion is constant from the highest part to the other end side, the height of the projection portion can prevent the medium from jumping up from the highest part to the other end side.

Aspect 3

In a preferable example (Aspect 3) of Aspect 1, the height of the projection portion may gradually become higher from one end side to the highest part in the second direction, and gradually become lower from the highest part to the other end side. In Aspect 3, since the height of the projection portion gradually becomes higher from one end side to the highest part in the second direction, it is possible to reduce the entry angle of the tip end of the medium with respect to the projection portion when the tip end of the medium comes into contact with one end side of the projection portion. For this reason, it is possible to prevent the tip end of the medium from being damaged. In addition, in Aspect 3, since the height of the projection portion gradually becomes lower from the highest part to the other end side, it is possible to adjust the medium not to be too suppressed, to further reduce the frictional resistance of the medium, and to prevent the medium from being clogged.

Aspect 4

In a preferable example (Aspect 4) of Aspect 1, the height of the projection portion may gradually become higher from one end side to the highest part in the second direction, and gradually become higher from the highest part to the other end side. In Aspect 4, since the height of the projection portion gradually becomes higher from one end side to the highest part in the second direction, it is possible to reduce the entry angle of the tip end of the medium with respect to the projection portion when the tip end of the medium comes into contact with one end side of the projection portion. For this reason, it is possible to prevent the tip end of the medium from being damaged. In addition, in Aspect 4, since the height of the projection portion gradually becomes higher from the highest part to the other end side, even in a case of curling characteristics in which a curl grows as the medium is transported, it is possible to effectively prevent the medium from floating up.

Aspect 5

According to a preferable example (Aspect 5) of the invention, there is provided a liquid ejecting head including: an ejection surface along which a plurality of nozzles that eject liquid are arranged in a first direction; and a plurality of projection portions which are provided in a long shape along a second direction that intersects with the first direction on the ejection surface, and protrude toward a side to which the liquid is emitted from the ejection surface, in which the ejection surface is divided into a first region, a second region, and a third region from one end side to the other end side in the first direction, and the projection portions are respectively disposed in the first region to the third region, and in which a height or a disposition density of the projection portion varies between the second region, and the first region and the third region which are at both ends of the second region. In this case, the ejection surface along which the plurality of nozzles that eject liquid are arranged in the first direction; and the plurality of projection portions which are provided in a long shape along the second direction that intersects with the first direction on the ejection surface, and protrude toward the side to which the liquid is emitted from the ejection surface, are provided. For this reason, even when the medium which is transported opposing the ejection surface is curled, it is possible to prevent the medium from floating up by the projection portion. In this manner, it is possible to prevent the medium from coming into contact with the ejection surface by the simple configuration in which the projection portion is provided on the ejection surface. Accordingly, it is possible to prevent the liquid remaining on the ejection surface from adhering to the medium.

In Aspect 5, the ejection surface is divided into the first region, the second region, and the third region from one end side to the other end side in the first direction, the projection portions are respectively disposed in the first region to the third region, and the height or the disposition density of the projection portion varies between the second region, and the first region and the third region which are at both ends of the second region. For this reason, for example, when the medium is curled in a direction of width (corresponding to the first direction) and the center portion of the medium floats up more than both end portions of the medium, or when both end portions of the medium float up more than the center portion of the medium, it is possible to effectively prevent the medium from floating up. In addition, regarding the region in which the height or the disposition density of the projection portions is low, it is possible to enhance the effect of making it difficult for the airflow which is generated as the liquid is ejected to remain on the ejection surface.

Aspect 6

In a preferable example (Aspect 6) of Aspect 5, a difference in the height or in the disposition density of the projection portion may gradually become larger from one end side to the other end side in the second direction between the second region, and the first region and the third region which are at both ends of the second region. In Aspect 6, since the difference in the height or in the disposition density of the projection portion gradually becomes larger from one end side to the other end side in the second direction between the second region, and the first region and the third region which are at both ends of the second region, even when the curl grows in the direction of width of the medium as the medium is transported, it is possible to effectively prevent the medium from floating up.

Aspect 7

In a preferable example (Aspect 7) of Aspect 5 or 6, on one end side in the second direction, the height or the disposition density of the projection portion may be the same for the second region, and the first region and the third region which are at both ends of the second region. In Aspect 7, on one end side in the second direction, the height or the disposition density of the projection portion is the same for the second region, and the first region and the third region which are at both ends of the second region. For this reason, even when the medium enters from one end side in the second direction, since the medium comes into contact with one end side of each projection portion, it is possible to effectively prevent the medium from coming into contact with the ejection surface without damaging the medium.

Aspect 8

In a preferable example (Aspect 8) of any one of Aspects 5 to 7, the projection portion may include a part in which the height varies from one end side to the other end side in the second direction, the width of the projection portion may become narrower from a base side to a tip end side in the direction of height, and the shapes of end portions of the projection portions on one end side and the other end side may be different from each other in the second direction. In Aspect 8, the projection portion includes a part in which the height varies from one end side to the other end side in the second direction, the width of the projection portion becomes narrower from the base side to the tip end side in the direction of height, and further, the shapes of end portions of the projection portions on one end side and the other end side may be different from each other in the second direction. For this reason, the position, the number, or the area in which the projection portion and the medium come into contact with each other changes from one end side to the other end side. Accordingly, since it is possible to prevent the tip end of the medium that comes into contact with the projection portion from being damaged, and to suppress the frictional resistance between the projection portion and the medium, it is possible to suppress deterioration of the transporting speed of the medium. In addition, in Aspect 1, the width of the projection portion becomes narrower from the base side to the tip end side in the direction of height. For this reason, since the space widens in the direction of height of the projection portion, it is possible to make it difficult for the airflow which is generated as the liquid is ejected, such as a vortex, to remain on the ejection surface.

Aspect 9

In a preferable example (Aspect 9) of any one of Aspects 1 to 8, the projection portion may be a triangle when the ejection surface is viewed from a plan view. In Aspect 9, since the projection portion is a triangle when the ejection surface is viewed from a plan view, on a triangular bottom side of the projection portion, it is possible to prevent the medium from floating up without damaging the tip end of the transported medium, and to further enhance the effect of making it difficult for the airflow to remain on the ejection surface across the triangular top of the projection portion.

Aspect 10

In a preferable example (Aspect 10) of any one of Aspects 1 to 9, the ejection surface may be formed of a fixed plate on which an opening portion that exposes the plurality of nozzles is formed, and the projection portion may be formed on the fixed plate. In Aspect 10, since the opening portion that exposes the plurality of nozzles is formed, and the projection portion is formed on the fixed plate which configures the ejection surface, it is possible to dispose the projection portion in the vicinity of the opening portion. Accordingly, it is possible to effectively prevent the medium from coming into contact with the opening portion.

Aspect 11

In a preferable example (Aspect 11) of Aspect 10, a plurality of opening portions may be formed on the fixed plate, and the projection portion may be formed between the adjacent opening portions. In Aspect 11, since the projection portion is formed between the adjacent opening portions, it is possible to accurately prevent the medium from coming into contact with each opening portion.

Aspect 12

According to a preferable example (Aspect 12) of the invention, there is provided a liquid ejecting apparatus including: a transporting mechanism which transports a medium in a transporting direction; and the liquid ejecting head according to any one of Aspects 1 to 11 which ejects liquid transported in the transporting direction onto the medium. In Aspect 2, even when the medium transported opposing the ejection surface is curled, it is possible to prevent the medium from floating up by the projection portion provided on the ejection surface. In this manner, it is possible to prevent the medium from coming into contact with the ejection surface by the simple configuration in which the projection portion is provided on the ejection surface. An appropriate example of the liquid ejecting apparatus is a printing apparatus which ejects the ink onto the medium, such as printing paper, but the purpose of the liquid ejecting apparatus according to the invention is not limited to printing.

BRIEF DESCRIPTION OF THE DRAWINGS

The invention will be described with reference to the accompanying drawings, wherein like numbers reference like elements.

FIG. 5A is a side view of the projection portion when viewed from an X direction when a front side in a Z direction is oriented downwardly. FIG. 5B is a view on one end side of the projection portion when viewed from an upstream side in a transporting direction (Y direction). FIG. 5C is a view on the other end side of the projection portion when viewed from a downstream side in the transporting direction. FIG. 5D is a plan view of the projection portion when viewed from a negative Z direction side.

FIG. 7A is a side view of the projection portion when viewed from the X direction when the front side in the Z direction is oriented downwardly. FIG. 7B is a view on one end side of the projection portion when viewed from the upstream side in the transporting direction (Y direction). FIG. 7C is a view on the other end side of the projection portion when viewed from the downstream side in the transporting direction. FIG. 7D is a plan view of the projection portion when viewed from the negative Z direction side.

FIG. 11A is a plan view when viewed from the negative Z direction side. FIG. 11B is a sectional view taken along line XIB-XIB. FIG. 11C is a sectional view taken along line XIC-XIC. FIG. 11D is a sectional view taken along line XID-XID.

FIG. 12A is a plan view when viewed from the negative Z direction side. FIG. 12B is a sectional view taken along line XIIB-XIIB. FIG. 12C is a sectional view taken along line XIIC-XIIC. FIG. 12D is a sectional view taken along line XIID-XIID.

FIG. 15A is a side view of the projection portion when viewed from the X direction when the front side in the Z direction is oriented downwardly. FIG. 15B is a view on one end side of the projection portion when viewed from the upstream side in the transporting direction (Y direction). FIG. 15C is a view on the other end side of the projection portion when viewed from the downstream side in the transporting direction. FIG. 15D is a plan view of the projection portion when viewed from the negative Z direction side.

FIG. 16A is a side view of the projection portion when viewed from the X direction when the front side in the Z direction is oriented downwardly. FIG. 16B is a view on one end side of the projection portion when viewed from the upstream side in the transporting direction (Y direction). FIG. 16C is a view on the other end side of the projection portion when viewed from the downstream side in the transporting direction. FIG. 16D is a plan view of the projection portion when viewed from the negative Z direction side.

DESCRIPTION OF EXEMPLARY EMBODIMENTS

Figure 1:
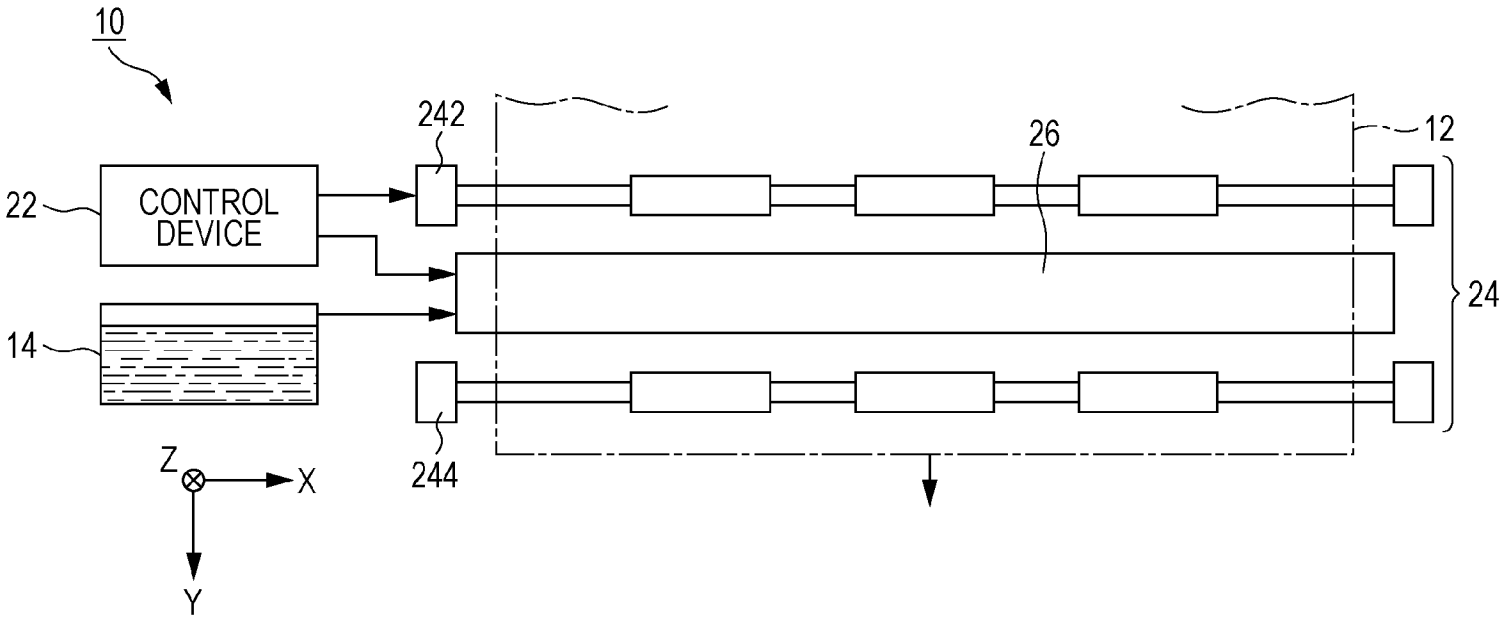
FIG. 1 is a configuration view of a printing apparatus in which a liquid ejecting apparatus according to an embodiment of the invention is employed.
Figure 2:
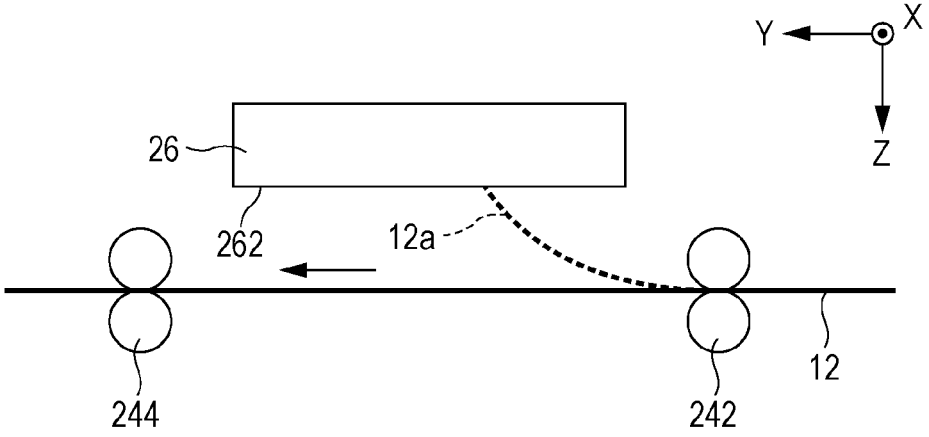
FIG. 2 is a view illustrating an operation of the printing apparatus illustrated in FIG. 1, focusing on the transporting of a medium.

First, a liquid ejecting apparatus according to an embodiment of the invention will be described by using an ink jet type printing apparatus as an example. FIG. 1 is a partial configuration view of a printing apparatus 10 according to the embodiment of the invention. FIG. 2 is a view illustrating an operation of the printing apparatus illustrated in FIG. 1, focusing on the transporting of the medium. The printing apparatus 10 of the embodiment is the liquid ejecting apparatus which ejects ink that is an example of liquid onto a medium (ejection target) 12, such as printing paper, and includes a control device 22, a transporting mechanism 24, and a liquid ejecting head 26. In the printing apparatus 10, a liquid container (cartridge) 14 which accumulates the ink is mounted, and the ink is supplied to the liquid ejecting head 26 from the liquid container 14.

The control device 22 integrally controls each element of the printing apparatus 10. The control device 22 includes a CPU, a ROM, and a RAM. In the ROM, various programs, such as a program which performs a printing operation executed by the CPU are stored. In addition, in the RAM, an arithmetic result of the CPU or various types of data which are processed by executing a control program are temporarily stored.

The transporting mechanism 24 includes a first roller 242 and a second roller 244, and transports the medium 12 in a Y direction (transporting direction) based on the control by the control device 22. The first roller 242 is disposed on a negative Y direction side (upstream side in the transporting direction of the medium 12) in the Y direction when viewed from the second roller 244, and transports the medium 12 to the second roller 244 side, and the second roller 244 transports the medium 12 supplied from the first roller 242 to a positive Y direction side. However, a structure of the transporting mechanism 24 is not limited to the above-described example.

The liquid ejecting head 26 of FIG. 1 is a line head which is long in an X direction (first direction) that is orthogonal to the Y direction. The liquid ejecting head 26 includes an ejection surface 262 on which a plurality of nozzles (ejection holes) N that eject the ink are provided. The liquid ejecting head 26 ejects the ink supplied from the liquid container 14 onto the medium 12 transported by the transporting mechanism 24 based on the control by the control device 22.

However, there is a case where a tip end 12*a* of the medium 12 is deformed (for example, curled) and transported between the first roller 242 and the second roller 244 as illustrated by a dotted line of FIG. 2. For example, assuming a case (duplex printing) where the medium 12 is sequentially reversed and the ink is ejected on both surfaces, deformation of the medium 12 particularly becomes more apparent in a state where the ink is ejected only onto one surface. If the ink is sufficiently dried in a state where the printing is performed only on one surface, deformation of the medium 12 can be suppressed. However, for example, in reality, it is difficult to ensure sufficient drying time when performing fast printing for printing multiple mediums 12 during a short period of time, and it is necessary to transport the medium 12 in a state of deformation to the liquid ejecting head 26 by the transporting mechanism 24. For this reason, when the curl of the tip end 12*a* of the medium 12 is large, there is a concern that the tip end 12*a* comes into contact with the ejection surface 262 of the liquid ejecting head 26, and at this time, when the ink remains on the ejection surface 262, there is a possibility that the ink adheres to the medium 12.

Here, in the embodiment, by using a configuration in which a projection portion which protrudes from the ejection surface 262 is formed on the ejection surface 262 of the liquid ejecting head 26, the medium 12 is prevented from floating up by the projection portion, and the medium 12 does not come into contact with the ejection surface 262. Accordingly, it is possible to effectively prevent the ink from adhering to the medium 12.

Figure 3:
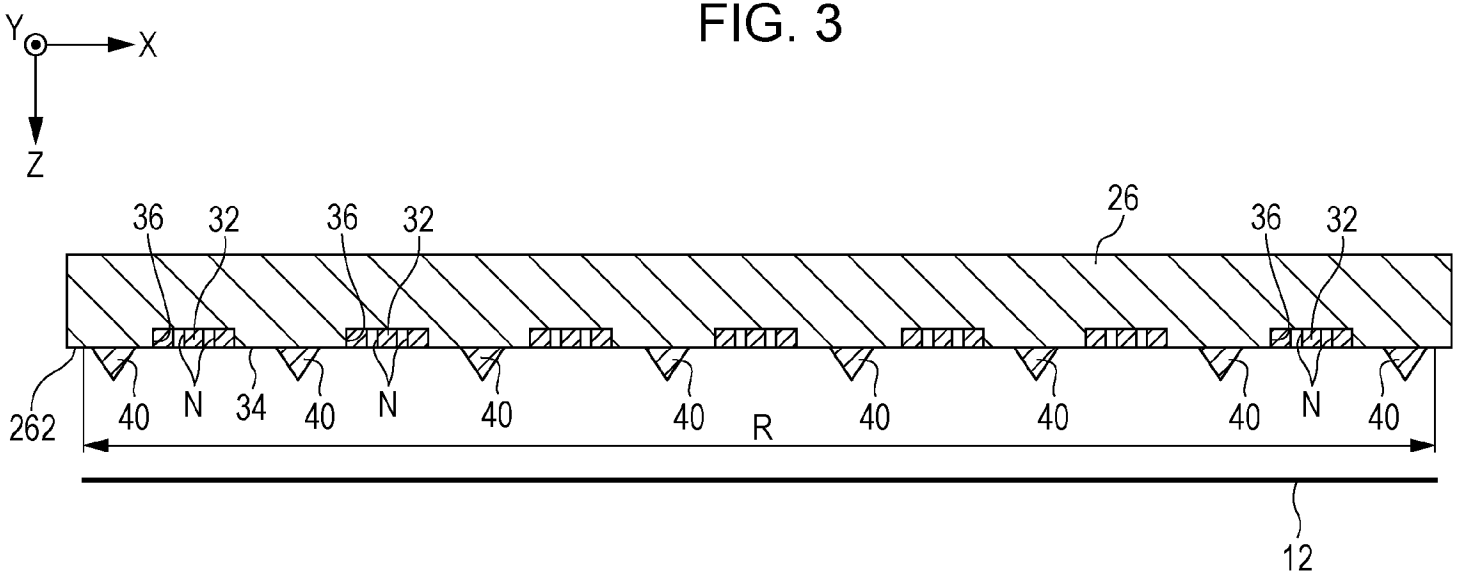
FIG. 3 is a sectional view illustrating a configuration example of a liquid ejecting head in the embodiment.

Here, a configuration example of the liquid ejecting head 26 provided with the projection portion will be described. FIG. 3 is a sectional view illustrating a configuration example of the liquid ejecting head 26 according to the embodiment. As illustrated in FIG. 3, the liquid ejecting head 26 is disposed so as to oppose the medium 12 at a predetermined interval in a state where the ejection surface 262 is parallel to an X-Y plane. As the ink is ejected from the nozzles N by the liquid ejecting head 26 at the same time as the medium 12 is transported by the transporting mechanism 24, a desired image is formed on a front surface of the medium 12. The plurality of nozzles N are installed on the ejection surface 262 of the liquid ejecting head 26. Specifically, the liquid ejecting head 26 is configured to attach a plurality of liquid ejecting portions (head chips) including a nozzle plate 32 on which the nozzles N are formed, to a fixed plate 34. In addition, the fixed plate 34 may be divided into plural plates, however, the number or the disposition of the nozzles N is not limited to the example illustrated in FIG. 3. In addition, hereinafter, a direction which is perpendicular to the X-Y plane (for example, a plane which is parallel to the front surface of the medium 12 which is not deformed) is expressed as a Z direction. A direction (for example, a vertically downward direction) in which the ink is ejected by the liquid ejecting head 26 corresponds to the Z direction. In addition, a lateral direction of a region (hereinafter, referred to as a "nozzle arrangement region") R in which the plurality of nozzles N are arranged on the ejection surface of the liquid ejecting head 26 corresponds to a Y direction, and a longitudinal direction of the nozzle arrangement region R corresponds to an X direction.

A projection portion 40 of the liquid ejecting head 26 illustrated in FIG. 3 is formed so as to protrude on a side to which the liquid is ejected from the plurality of nozzles N of the ejection surface 262. Specifically, the projection portion 40 is formed so as to be long (a straight line shape) from the upstream side to the downstream side in the Y direction (here, the same direction as the transporting direction), and to protrude toward a positive Z direction side from the ejection surface 262 (fixed plate 34). A plurality of opening portions 36 are formed on the ejection surface 262, and the plurality of liquid ejecting portions (head chips) including the nozzle plate 32 are attached to the fixed plate 34 so that the nozzles N are exposed from the opening portion 36. The nozzles N are arranged in two rows along a W direction which intersects with the X direction. The projection portion 40 is disposed between the opening portions 36. In this manner, by disposing the projection portion 40 between the opening portions 36, it is possible to effectively prevent the ink remaining in the opening portion 36 from adhering to the medium 12. The projection portion 40 may be integrally configured with the fixed plate 34, or may be separately configured. In addition, the number or the disposition of the nozzle plate 32, the nozzles N, and the opening portions 36 is not limited to the example illustrated in FIG. 3.

Figure 4:
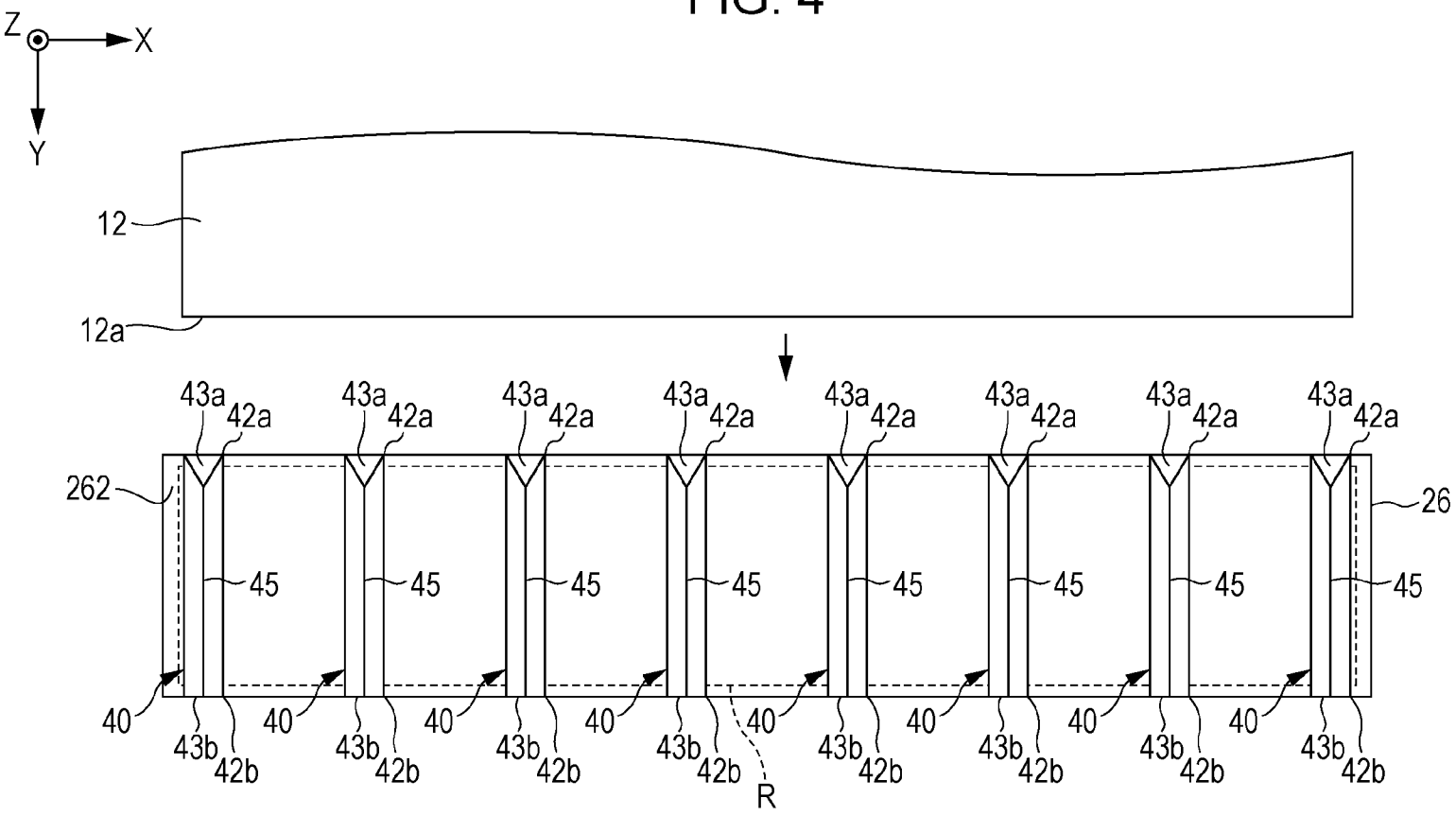
FIG. 4 is a plan view illustrating a configuration of a case where a bottom surface of a projection portion disposed on an ejection surface illustrated in FIG. 3 is a rectangle.
Figures 5A, 5B, 5C, 5D:
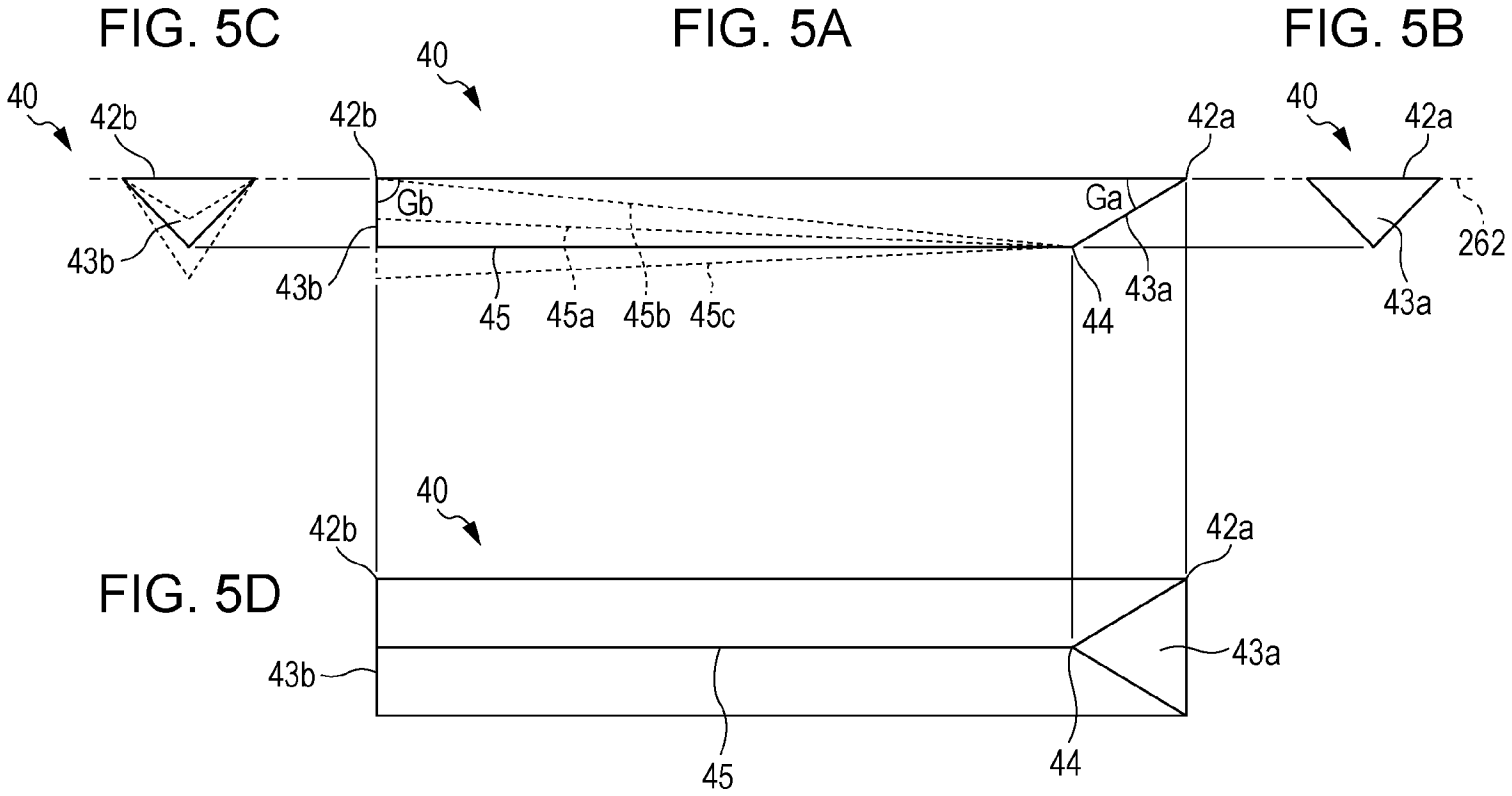
FIGS. 5A to 5D are views illustrating an external configuration of the projection portion illustrated in FIG. 4.

Next, a shape of the projection portion 40 will be described in more detail. FIGS. 5A to 5D are views illustrating an external configuration of the projection portion 40 in which a bottom surface illustrated in FIG. 4 is a rectangle. FIG. 5A is a side view of the projection portion when viewed from the X direction when the front side in the Z direction is oriented downwardly. FIG. 5B is a view on one end side of the projection portion when viewed from the upstream side in the transporting direction (Y direction). FIG. 5C is a view on the other end side of the projection portion when viewed from the downstream side in the transporting direction. FIG. 5D is a plan view of the projection portion when viewed from the negative Z direction side. The projection portion 40 illustrated in FIGS. 5A to 5D is a long rectangle in which the bottom surface on the ejection surface 262 side is elongated from the upstream side to the downstream side in the transporting direction (Y direction). The projection portion 40 protrudes toward a side (positive Z direction side) to which the ink is ejected from the ejection surface 262. The width in the direction (here, X direction) which intersects with the longitudinal direction of the projection portion 40 becomes narrower from a base side to the tip end side in the height direction (Z direction). Accordingly, as can be understood from FIG. 4, since the interval between two projection portions 40 adjacent to each other gradually becomes wider from the base side to the tip end side in the direction of height of the projection portion 40, it is possible to make it difficult for an airflow which is generated as the ink is ejected, such as a vortex, to remain on the ejection surface 262. Accordingly, since it is possible to make it difficult for the ink ejected toward the medium 12 from the nozzles N of the ejection surface 262 to be influenced by the airflow, it is possible to improve the printing quality.

In the projection portion 40, the shapes of one end portion 42*a* positioned on the upstream side in the transporting direction and the other end portion 42*b* positioned on the downstream side, are formed so as to vary. While an end surface 43*a* of one end portion 42*a* of the projection portion 40 illustrated in FIG. 5 is inclined so that an angle Ga made by the ejection surface 262 becomes an acute angle (0 degrees<Ga<90 degrees), an end surface 43*b* of the other end portion 42*b* stands straight so as not to be inclined at an acute angle with respect to the ejection surface 262, making a right angle.

Specifically, as one end portion 42*a* of the projection portion 40 illustrated in FIG. 5 makes the end surface 43*a* having an inverted triangle shape that becomes a projection toward the positive Z direction side as illustrated in FIG. 5A, inclined so that the angle Ga made by the ejection surface 262 becomes an acute angle as illustrated in FIG. 5B, a contact area with the medium 12 becomes as large as possible, and an entry angle of the tip end 12*a* of the medium 12 becomes an acute angle with respect to the end surface 43*a*. Since one end portion 42*a* of the projection portion 40 is positioned on the upstream side which becomes an inlet to which the medium 12 enters, even when the tip end 12*a* of the medium 12 which has entered the inlet is in contact with the end surface 43*a* of one end portion 42*a*, the tip end 12*a* of the medium 12 is not damaged.

In contrast to this, the other end portion 42*b* of the projection portion 40 illustrated in FIGS. 5A to 5D makes the end surface 43*b* having an inverted triangle shape that becomes a projection toward the positive Z direction side as illustrated in FIG. 5C, stand straight so that an angle Gb made by the ejection surface 262 becomes a right angle as illustrated in FIG. 5C. Since the other end portion 42*b* of the projection portion 40 is positioned on the downstream side which becomes an outlet from which the medium 12 transported opposing the ejection surface 262 is fed, the end surface 43*b* of the other end portion 42*b* does not become inclined at an acute angle so that a rear end of the fed medium 12 does not jump up. In addition, in the end surface 43*b* of the other end portion 42*b*, the angle Gb made by the ejection surface 262 may become an obtuse angle (90 degrees<Ga<180 degrees).

The projection portion 40 is formed so as to include a part in which the height thereof varies from one end side (upstream side in the transporting direction) to the other end side (downstream side in the transporting direction). As illustrated in FIG. 5A, the height of the projection portion 40 gradually becomes higher along the inclination of the end surface 43*a* of one end portion 42*a* from one end side to the other end side, from a height similar to the ejection surface 262 (the height is almost zero), and becomes the highest at a top 44 of the end surface 43*a*. When a tip end portion which links the top 44 to the end surface 43*b* on the other end side is a top portion 45, the height of the top portion 45 does not change, and is parallel to the ejection surface 262. According to this, even if the tip end 12*a* of the medium 12 is curled from the beginning, enters the ejection surface 262, and comes into contact with the projection portion 40, along the end surface 43*a* of one end portion 42*a* in the projection portion 40, the tip end 12*a* is gradually induced toward the top 44 of the end surface 43*a*. At this time, since the height of the projection portion 40 gradually becomes higher, and the width of the end surface 43*a* gradually becomes narrower as illustrated in FIG. 5D, while preventing the medium 12 from floating up, the contact area with the projection portion 40 gradually becomes smaller, and the contact area with the medium 12 at the top 44 at which the height of the projection portion 40 becomes the highest becomes the smallest. Since the height of the projection portion 40 does not change from the top 44 to the end surface 43*b* of the other end portion 42*b*, even when the medium 12 comes into contact with the projection portion 40 between the top 44 and the end surface 43*b*, the contact area at this time does not change. Accordingly, since it is possible to suppress the frictional resistance between the medium 12 and the projection portion 40, it is possible to suppress deterioration of the transporting speed of the medium 12. In addition, since the height of the projection portion 40 does not change from the top 44 to the end surface 43*b* of the other end portion 42*b*, it is possible to prevent the medium 12 from jumping up while the medium 12 is approaching the other end portion 42*b* from the top 44.

In addition, as the height of the end surface 43*b* of the other end portion 42*b* of the projection portion 40 changes, it is possible to change the inclination (height of the tip end of the projection portion 40) of the top portion 45 from the top 44 to the downstream side of the projection portion 40. In a top portion 45*a* illustrated by a dotted line of FIG. 5A, there is a case where the height of the tip end of the projection portion 40 gradually becomes lower from the upstream side to the downstream side as the height of the top of the end surface 43*b* of the other end portion 42*b* becomes lower. In a top portion 45*b* illustrated by the dotted line of FIG. 5B, the height of the top of the end surface 43*b* is much lower than the top portion 45*a*, and is the same as the ejection surface 262 (the height is almost zero). In this manner, as much as the height of the top of the end surface 43*b* of the other end portion 42*b* becomes lower, the height of the top portion 45 can be largely reduced from the upstream side to the downstream side in the transporting direction. Conversely, as the height of the top of the end surface 43*b* of the other end portion 42*b* of the projection portion 40 becomes higher than that in a case of the top portion 45, the height of the tip end of the projection portion 40 can be increased from the upstream side to the downstream side in the transporting direction. In a top portion 45*c* illustrated by a dotted line of FIG. 5B, as the height of the top of the end surface 43*b* of the other end portion 42*b* becomes higher, there is a case where the height of the tip end of the projection portion 40 gradually becomes higher from the upstream side to the downstream side.

Figure 6:
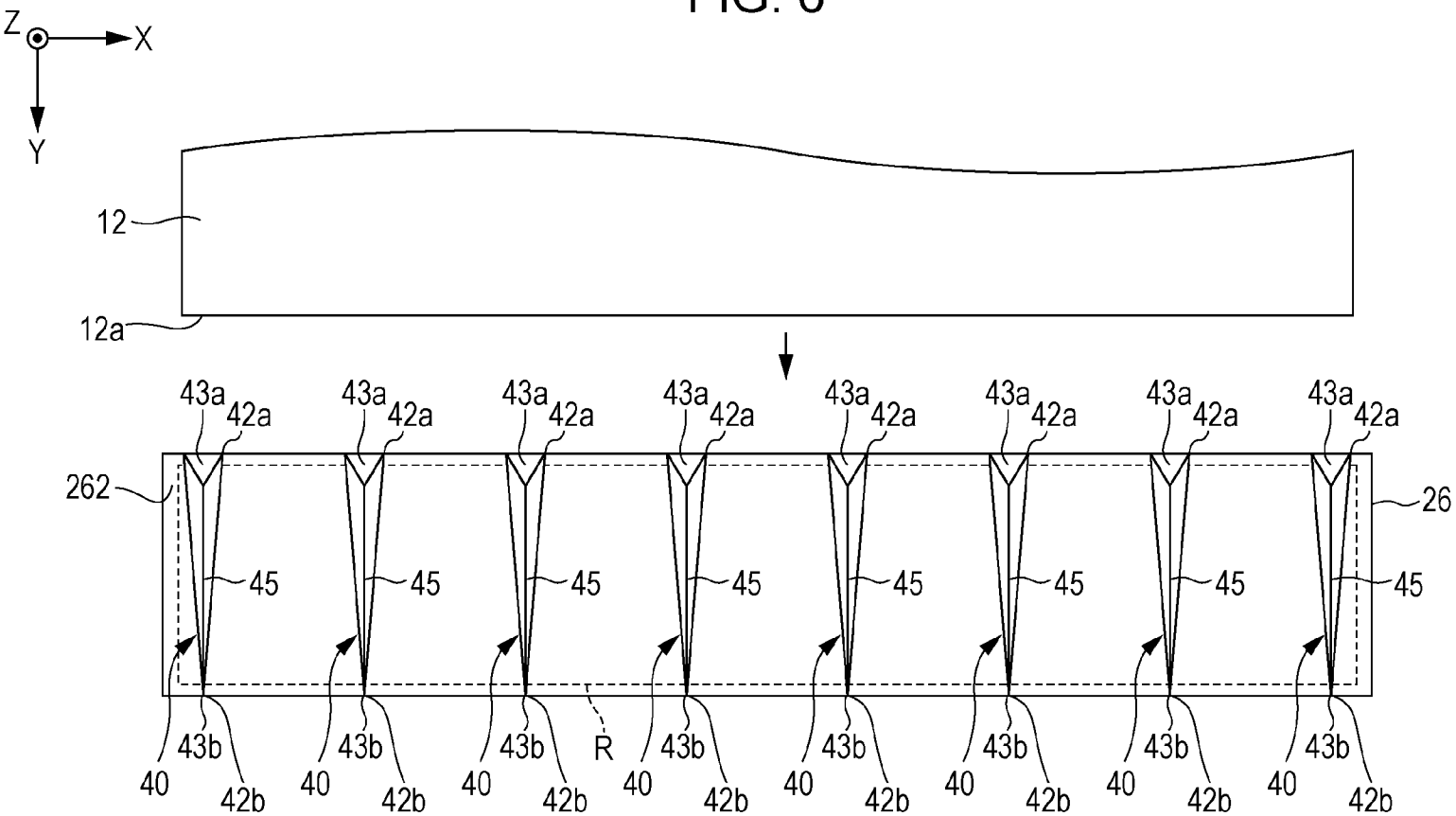
FIG. 6 is a plan view illustrating a configuration of a case where the bottom surface of the projection portion disposed on the ejection surface illustrated in FIG. 3 is a triangle.
Figures 7A, 7B, 7C, 7D:
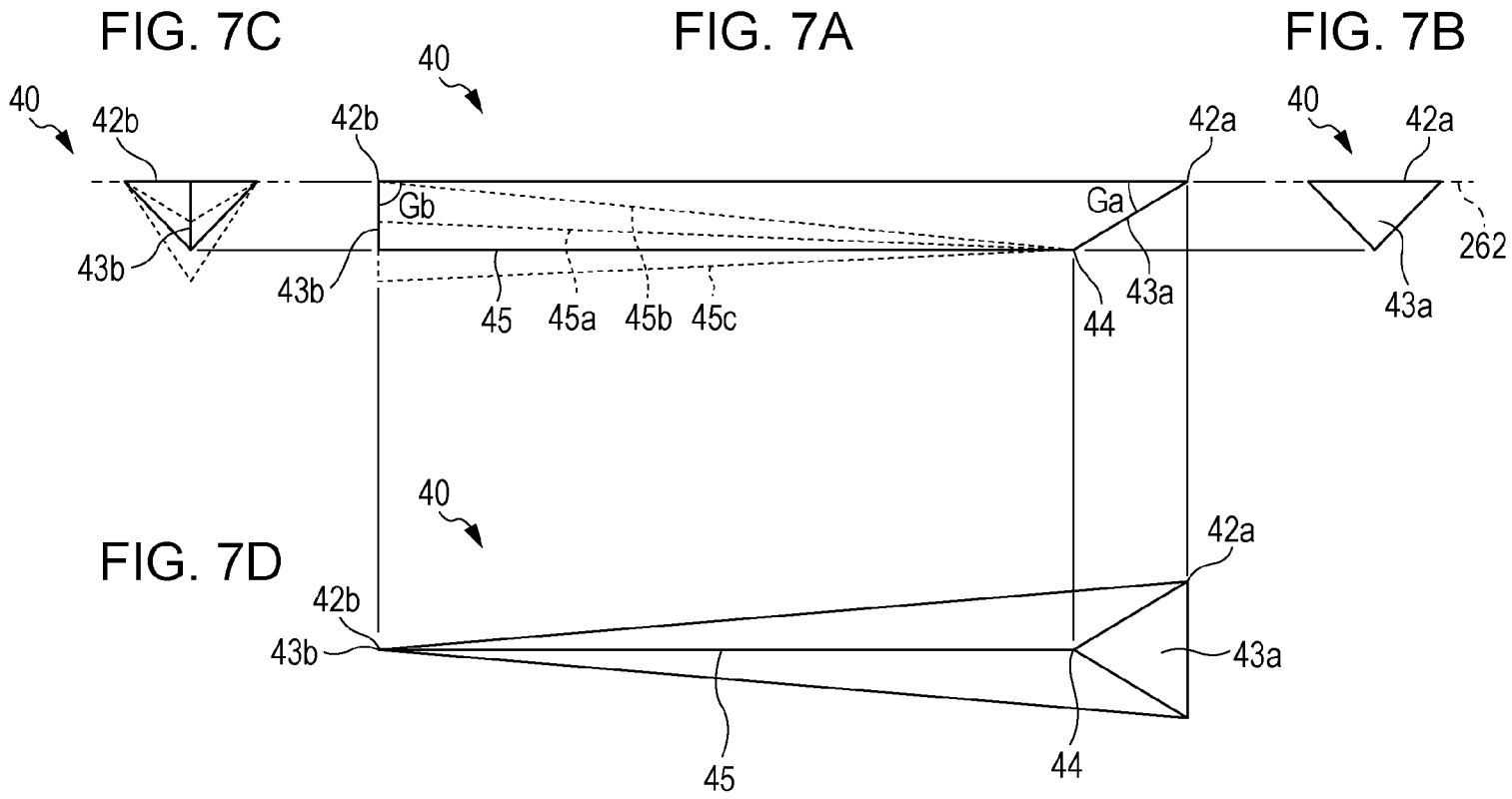
FIGS. 7A to 7D are views illustrating an external configuration of the projection portion illustrated in FIG. 6.

In addition, the shape of the bottom surface of the projection portion 40 may have a triangle shape as illustrated in FIGS. 6, and 7A to 7D, being not limited to a rectangle as illustrated in FIGS. 4, and 5A to 5D. FIG. 6 is a plan view illustrating a configuration of a case where the bottom surface of the projection portion 40 disposed on the ejection surface 262 illustrated in FIG. 3 has a triangle shape, and corresponds to FIG. 4. FIGS. 7A to 7D are views illustrating an external configuration of the projection portion 40 illustrated in FIG. 6. FIG. 7A is a side view of the projection portion 40 when viewed from the X direction when the positive Z direction side is oriented downwardly. FIG. 7B is a view on one end side of the projection portion 40 when viewed from the upstream side in the transporting direction (Y direction). FIG. 7C is a view on the other end side of the projection portion 40 when viewed from the downstream side in the transporting direction. FIG. 7D is a plan view of the projection portion 40 when viewed from the negative Z direction side. FIGS. 7A to 7D correspond to FIGS. 5A to 5D.

The bottom surface of the projection portion 40 illustrated in FIGS. 6, and 7A to 7D has a triangle shape in which the upstream side in the transporting direction is a bottom side, and the downstream side is a top. For this reason, in the projection portion 40 illustrated in FIGS. 7A to 7D, the width on the base side of the projection portion 40 also becomes smaller from the upstream side to the downstream side in the transporting direction. According to this, the width of the projection portion 40 from the base side to the tip end side of the projection portion 40 can become narrower than the projection portion 40 illustrated in FIGS. 5A to 5D. In this manner, as the bottom surface of the projection portion 40 has a triangle shape, as illustrated in FIG. 6, the interval between two projection portions 40 adjacent to each other can gradually become wider from the upstream side to the downstream side in the transporting direction. According to this, on the upstream side (bottom side on the bottom surface having a triangle shape of the projection portion 40), it is possible to prevent the tip end 12*a* of the transported medium 12 from floating up without a damage, and to further enhance the effect of making it difficult for the airflow to remain on the ejection surface 262 to the downstream side (top of the bottom surface having a triangle shape of the projection portion 40).

In addition, even in the projection portion 40 illustrated in FIGS. 7A to 7D, similar to the projection portion 40 illustrated in FIGS. 5A to 5D, as the height of the top of the end surface 43*b* of the other end portion 42*b* changes, the inclination (height of the tip end of the projection portion 40) of the top portion 45 from the top 44 of the projection portion 40 to the downstream side can be changed. In the top portion 45*a* illustrated by a dotted line of FIG. 7B, as the height of the top of the end surface 43*b* of the other end portion 42*b* becomes lower than that in a case of the top portion 45, there is a case where the height of the tip end of the projection portion 40 from the upstream side to the downstream side gradually becomes lower. In the top portion 45*b* illustrated by a dotted line of FIG. 7B, the height of the top of the end surface 43*b* is much lower than the top portion 45*a*, and is the same as the ejection surface 262 (the height is almost zero). In this manner, as much as the height of the top of the end surface 43*b* of the other end portion 42*b* becomes lower, the height of the top portion 45 can be largely reduced from the upstream side to the downstream side in the transporting direction. Conversely, as the height of the top of the end surface 43*b* of the other end portion 42*b* of the projection portion 40 becomes higher than that in a case of the top portion 45, the height of the tip end of the projection portion 40 can be increased from the upstream side to the downstream side in the transporting direction. In the top portion 45*c* illustrated by a dotted line of FIG. 7B, as the height of the top of the end surface 43*b* of the other end portion 42*b* becomes higher than that in a case of the top portion 45, there is a case where the height of the tip end of the projection portion 40 gradually becomes higher from the upstream side to the downstream side.

Figure 8:
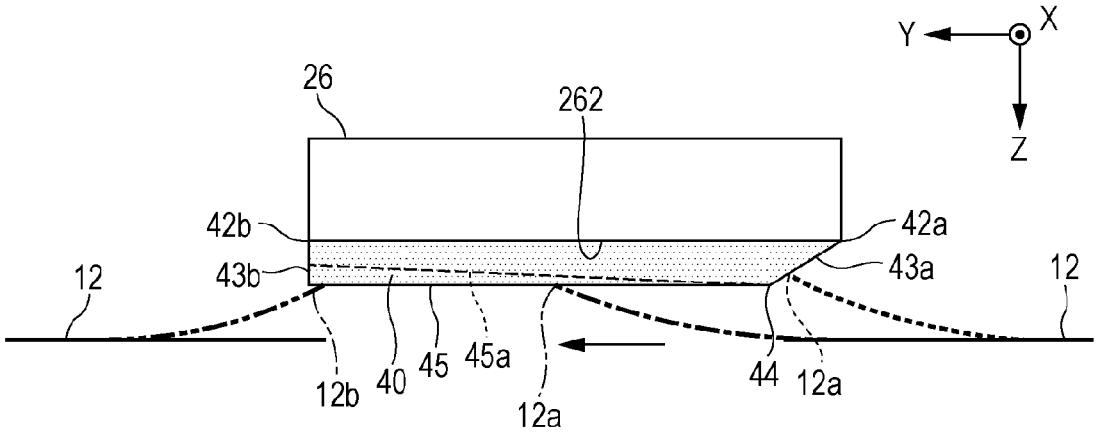
FIG. 8 is a view illustrating an action in a case where the curled medium is transported, with respect to the ejection surface in the embodiment.

Next, an action in a case where the curled medium 12 is transported with respect to the ejection surface 262 in the embodiment will be described. FIG. 8 is a view illustrating the action in a case where the curled medium 12 is transported, with respect to the ejection surface 262 in the embodiment. As illustrated in FIG. 8, even when the curled medium 12 is transported, since the tip end 12*a* of the medium 12 is suppressed by the projection portion 40 that protrudes from the ejection surface 262, it is possible to prevent the tip end 12*a* of the medium 12 from coming into contact with the ejection surface 262. Furthermore, in the embodiment, by devising the shape of the projection portion 40, it is possible to suppress damage when the tip end 12*a* of the medium 12 enters, and to suppress deterioration of the transporting speed by reducing the frictional resistance of the medium 12.

Specifically, as illustrated by a dotted line of FIG. 8, when the tip end 12*a* of the medium 12 is transported while being curled, the tip end 12*a* of the medium 12 comes into contact with the end surface 43*a* which is inclined at an acute angle in one end portion 42*a* of the projection portion 40. Accordingly, it is possible to increase the contact area between the tip end 12*a* and the end surface 43*a* of the projection portion 40 in the direction of width (X direction) of the medium 12 as illustrated in FIG. 8, and at the same time, it is possible to reduce the contact area so that the entry angle of the tip end 12*a* of the medium 12 with respect to the end surface 43*a* becomes an acute angle in the transporting direction (Y direction). Accordingly, compared to a case where the end surface 43*a* stands straight without being inclined with respect to the ejection surface 262, it is possible to remarkably reduce a possibility that the tip end 12*a* of the medium 12 is damaged. In this manner, the tip end 12*a* of the medium 12 which comes into contact with the end surface 43*a* of the projection portion 40 is prevented from being smoothly guided to the positive Z direction side to the top 44 along the end surface 43*a* and floating up. Accordingly, when the medium 12 enters, it is possible to prevent the tip end 12*a* of the medium 12 from coming into contact with a part other than the projection portion 40 of the ejection surface 262.

In addition, between the top 44 of the projection portion 40 and the end surface 43*b* on the downstream side as illustrated by one-dot chain line of FIG. 8, when the tip end 12*a* of the medium 12 is curled, as the tip end 12*a* of the medium 12 comes into contact with the top portion 45, it is possible to prevent the tip end 12*a* of the medium 12 from coming into contact with the ejection surface 262. In this case, since the tip end of the top portion 45 is sharp, the contact area with the medium 12 becomes smaller than the end surface 43*a*. For this reason, even when the tip end 12*a* of the medium 12 is transported while being in contact with the top portion 45 of the projection portion 40, it is possible to suppress deterioration of the transporting speed of the medium 12. In this manner, while the medium 12 is transported, the ink is ejected from the nozzles N of the ejection surface 262, and the medium 12 is printed. After this, when a rear end 12*b* of the medium 12 is transported from the ejection surface 262 as illustrated by a two-dot chain line of FIG. 8, the medium 12 is prevented from jumping up by the end surface 43*b* of the other end portion 42*b* on the downstream side of the projection portion 40.

In this manner, in the embodiment, since the projection portion 40 which is long from the upstream side to the downstream side in the transporting direction is provided on the ejection surface 262 as illustrated in FIG. 4 or 6, it is possible to prevent the medium 12 from floating up at any position from the upstream side to the downstream side in the transporting direction. Accordingly, it is possible to accurately prevent the medium 12 from coming into contact with the ejection surface 262. Furthermore, as the height of the projection portion 40 changes from one end side to the other end side in the transporting direction (first direction), and the shape of the end portion of the projection portion varies, it is possible to prevent the tip end 12*a* of the medium 12 from being damaged when the tip end 12*a* enters, and then, to suppress deterioration of the transporting speed by reducing the frictional resistance of the medium 12, and to prevent the medium 12 from jumping up when being transported. In addition, as the height of the projection portion 40 gradually becomes lower from the top 44 of the projection portion 40 to the other end portion 42*b* as illustrated by a dotted line of FIG. 8 (for example, the top portion 45*a* of FIGS. 5A to 5D or 7A to 7D), it is possible to adjust the medium 12 not to be too suppressed, to further reduce the frictional resistance of the medium 12, and to prevent the medium from being clogged (jammed). In addition, as the height of the projection portion 40 gradually becomes higher, from the top 44 of the projection portion 40 to the other end portion 42*b* (for example, the top portion 45*c* in FIGS. 5A to 5D or 7A to 7D), even when the curl of the tip end grows following the transporting of the medium 12, it is possible to effectively prevent the medium 12 from floating up.

However, a case where the tip end 12*a* of the medium 12 is curled in the transporting direction (Y direction) in FIG. 8 is described, but there is also a case where the medium 12 is curled in the direction of width (X direction). On the medium 12 transported opposing the ejection surface 262, the ink ejected from the nozzles N lands, and then, spreads on the front surface of the medium 12. In addition, the ink infiltrates into fibers that configure the medium 12, the moisture in the ink is evaporated, and the ink is fixed and dried on the medium 12. At this time, for example, when the image is printed only on one surface of the medium 12, the moisture in the ink infiltrates into the fibers of the medium 12, and only the fibers on the printing surface side swells. For this reason, as illustrated by a dotted line of FIG. 9, the printing surface side in the center portion is curled to float up more than in both end portions in the direction of width (X direction) of the medium 12. In addition, the moisture in the ink which infiltrates into the fibers of the medium 12 is evaporated as time elapses, and the fibers on the printing surface side contracts more than the fibers before the printing. For this reason, the medium 12 becomes curled so that both end portions float up more than the center portion in a direction reverse to the direction immediately after the printing as illustrated by the dotted line of FIG. 10, that is, in the direction of width (X direction) of the medium 12.

Figure 9:
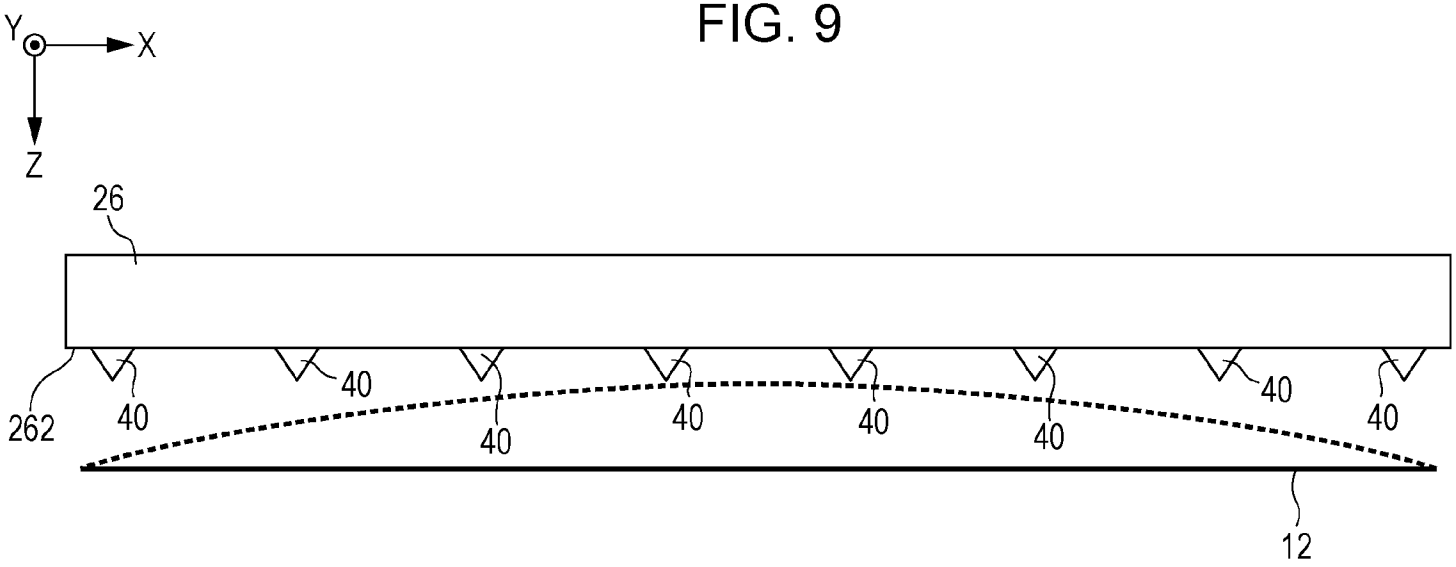
FIG. 9 is a view illustrating an action for illustrating curling characteristics in which the center portion of the transported medium floats up with respect to the ejection surface of the embodiment.
Figure 10:
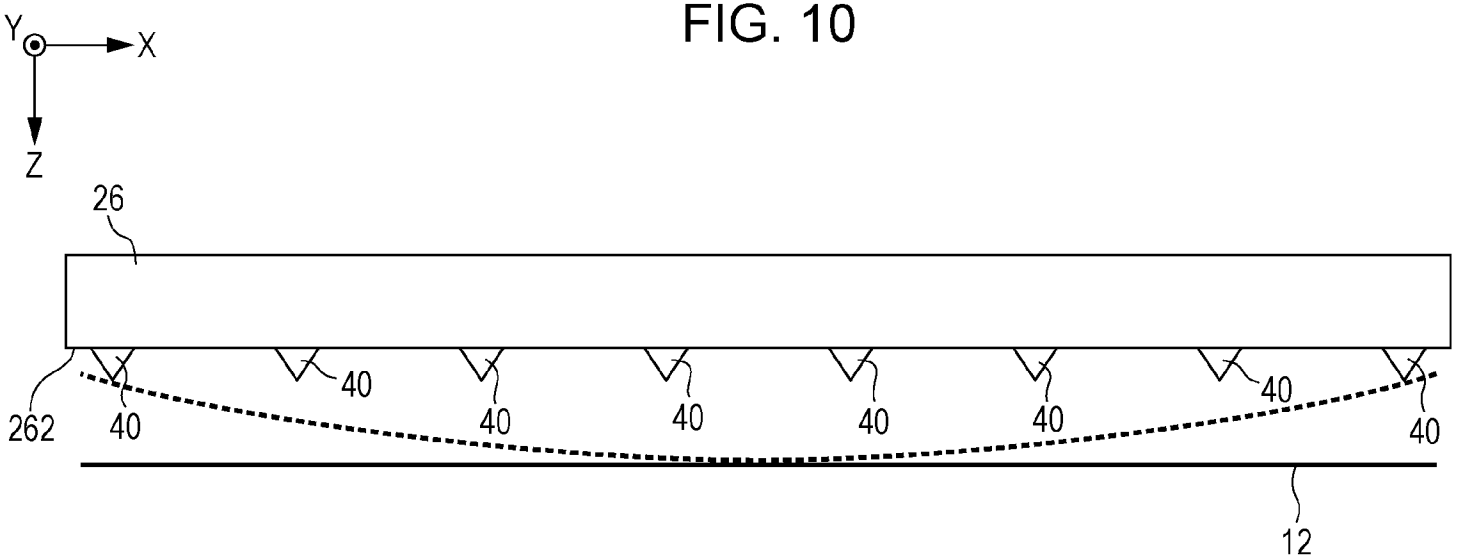
FIG. 10 is a view illustrating an action for illustrating the curling characteristics in which both end portions of the transported medium floats up with respect to the ejection surface of the embodiment.

In addition, since the curl of FIG. 9 or 10 is generated as time elapses in this manner, there is a possibility that the curl of FIG. 9 or 10 is generated in accordance with the transporting speed. For example, when the transporting speed of the medium 12 is high, there is a high possibility that the medium 12 is fed from the ejection surface 262 before being dried while the center of the medium 12 floats up as illustrated in FIG. 9 by the ink soaked in the medium 12. In contrast to this, when the transporting speed of the medium 12 is low, there is a high possibility that the medium 12 is transported opposing the ejection surface 262 while the ink soaked in the medium 12 is dried and both end portions of the medium 12 floats up as illustrated in FIG. 10. Therefore, when the transporting speed of the medium 12 is high, the center of the medium 12 floats up as illustrated in FIG. 9, and when the transporting speed of the medium 12 is low, both end portions of the medium 12 floats up as illustrated in FIG. 10.

In this regard, in the embodiment, the plurality of projection portions 40 are provided along the X direction which is the direction of width of the medium 12. For this reason, even in a case where the medium 12 is curled in the center portion in the direction of width as illustrated in FIG. 9, or even in a case where the medium 12 is curled in both end portions as illustrated in FIG. 10, since the floated part comes into contact with any of the projection portions 40 which is disposed in the center portion or both end portions in the X direction of the ejection surface 262, it is possible to prevent the medium 12 from coming into contact with the ejection surface 262. In addition, as the shape of the projection portion 40 disposed on the ejection surface 262 changes in accordance with the curling characteristics of the medium 12, it is possible to more accurately prevent the medium 12 from floating up when the medium 12 is curled.

Figure 11A:
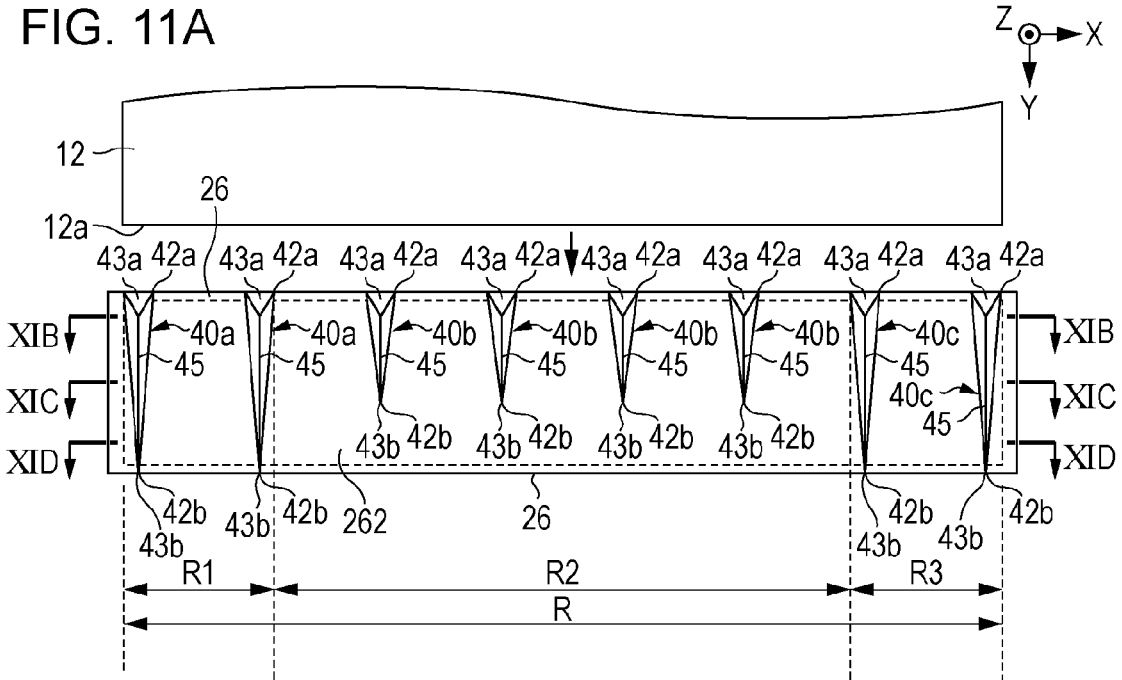
FIGS. 11A to 11D are plan views illustrating a configuration example of the ejection surface of the liquid ejecting head configured in accordance with the curling characteristics of the medium.
Figure 11B:
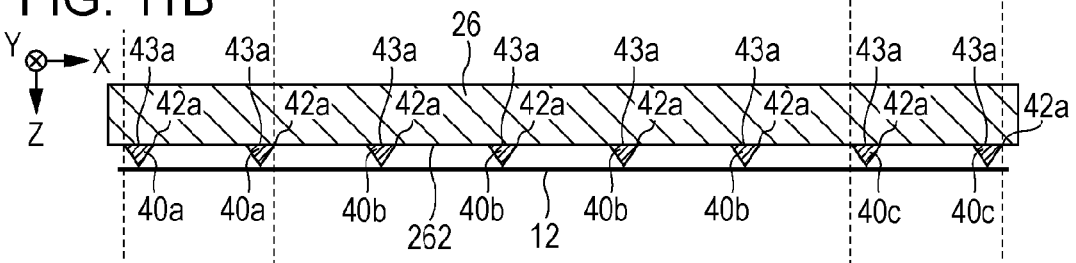
Figure 11C:
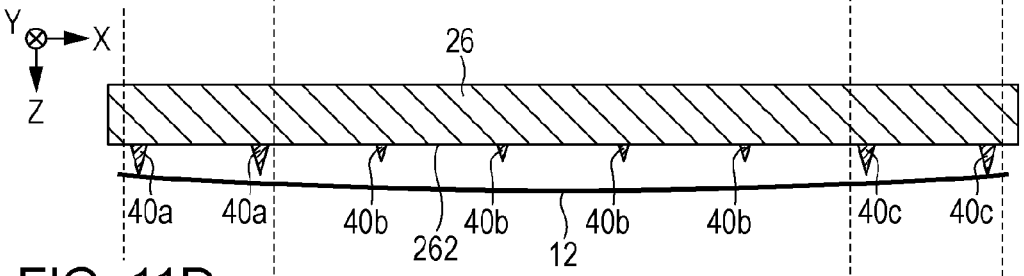
Figure 11D:
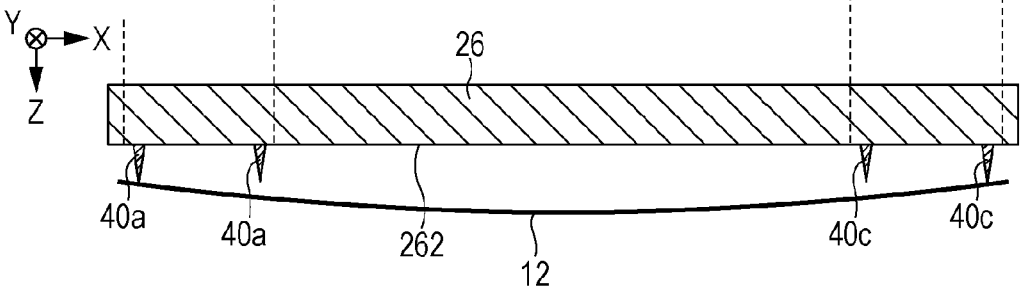

Here, the ejection surface 262 on which the shape of the projection portion 40 disposed on the ejection surface 262 changes in accordance with the curling characteristics of the medium 12 will be described. Here, a case where the medium 12 is curled so that both end portions of the medium 12 float up as illustrated in FIG. 10 after the medium 12 enters the ejection surface 262, will be described. FIGS. 11A to 11D are views illustrating the ejection surface 262 of the liquid ejecting head 26 configured in accordance with the curling characteristics of the medium 12. FIG. 11A is a plan view when viewed from the negative Z direction side. FIG. 11B is a sectional view taken along line XIB-XIB. FIG. 11C is a sectional view taken along line XIC-XIC. FIG. 11D is a sectional view taken along line XID-XID. FIGS. 11B to 11D illustrate a change in the height of the projection portion 40 from the upstream side to the downstream side. In addition, in FIGS. 11A to 11D, in order to make it easy to understand, configuration elements, such as the nozzles N, other than the projection portion 40, will be omitted.

For convenience, on the ejection surface 262 illustrated in FIGS. 11A to 11D, the nozzle arrangement region R of the ejection surface 262 is divided into a first region R1, a second region R2, and a third region R3 so that a ratio of the lengths in the X direction of the first region R1, the second region R2, and the third region R3 becomes 1:2:1, for example. The second region R2 corresponds to a center region, and the first region R1 and the third region R3 correspond to the end portion regions on both sides of the center region. However, the ratio of dividing the nozzle arrangement region R of the ejection surface 262 is not limited thereto.

In the first region R1 which is one end portion region of the ejection surface 262 illustrated in FIG. 11A, a projection portion 40*a* which extends from the upstream side to the downstream side in the transporting direction, and in which the height from the upstream side to the downstream side becomes higher, is disposed. In a projection portion 40*c* which is disposed in the third region R3 that is the other end portion region of the ejection surface 262, in accordance with the curling characteristics of the medium 12 in which both end portions float up as illustrated in FIG. 10, the shape which is similar to the shape of the projection portion 40*a* disposed in the first region R1 is formed. As the shape of the projection portions 40*a* and 40*c*, an inclination in which the height gradually becomes higher similar to the top portion 45*c* in the projection portion 40 illustrated in FIGS. 7A to 7D is disposed. In contrast to this, in the second region R2 which is the center region of the ejection surface 262, the projection portion 40*b* which is shorter than the projection portions 40*a* and 40*c* is disposed. As the shape of the projection portion 40*b*, an inclination in which the height gradually becomes lower similar to the top portion 45*b* in the projection portion 40 illustrated in FIGS. 7A to 7D is disposed. In addition, the position of the end surface 43*a* in the Y direction is common to all of the regions.

According to the ejection surface 262 of the liquid ejecting head 26 illustrated in FIG. 11A, on a sectional surface taken along line XIB-XIB which is close to the upstream side in the transporting direction, the projection portions 40*a*, 40*b*, and 40*c* in all of the first region R1, the second region R2, and the third region R3 are similarly arranged in the X direction as illustrated in FIG. 11B. For this reason, even when the tip end 12*a* of the medium 12 is curled and enters the transporting direction as illustrated in FIG. 8, the tip end 12*a* comes into contact with the end surface 43*a* of one end portion 42*a* of each of the projection portions 40*a*, 40*b*, and 40*c*. Therefore, it is possible to prevent the medium 12 from coming into contact with the ejection surface 262 without damaging the medium 12. In addition, since the tip end 12*a* of the medium 12 similarly comes into contact with the end surface 43*a* of one end portion 42*a*, it is possible to prevent the medium 12 from obliquely moving or meandering.

In the sectional view taken along line XIC-XIC in the middle of the transporting direction, while the height of the projection portion 40*b* of the center region (second region R2) as illustrated in FIG. 11C becomes lower, the height of the projection portions 40*a* and 40*c* of the end portion regions (the first region R1 and the third region R3) becomes higher. Furthermore, on a sectional surface taken along line XID-XID which is close to the downstream side in the transporting direction, the projection portion 40*b* of the center region (second region R2) as illustrated in FIG. 11D disappears, and the height of the projection portions 40*a* and 40*c* of the end portion regions (the first region R1 and the third region R3) becomes much higher. Accordingly, even when the ink ejected onto the medium 12 is dried, both end portions in the direction of width of the medium 12 starts to be curled as illustrated in FIG. 11C, and the curl grows as illustrated in FIG. 11D, the height of the projection portions 40*a* and 40*c* of the end portion regions becomes higher than the projection portion 40*b* of the center region. For this reason, it is possible to accurately prevent both end portions of the medium 12 from floating up by the projection portions 40*a* and 40*c*. In addition, in the center region (second region R2), since the height of the projection portion 40*b* becomes lower, it is possible to make it difficult for the airflow which is generated as the ink is ejected to remain on the ejection surface 262.

In addition, in FIGS. 11A to 11D, a case where a difference in the heights of the projection portions becomes large between the center region and the end portion regions so that the height of the projection portion of the end portion regions (the first region R1 and the third region R3) becomes higher than that of the center region (second region R2) from the upstream side to the downstream side on the ejection surface 262 in order to prevent both end portions in the direction of width of the medium 12 from floating up, is provided. However, the invention is not limited thereto. For example, a difference in the disposition density of the projection portions between the center region and the end portion regions may be large so that the disposition density (the number of projection portions 40 per unit area of the ejection surface 262) of the projection portion of the end portion regions (the first region R1 and the third region R3) becomes higher than the disposition density of the center region (second region R2) from the upstream side to the downstream side of the ejection surface 262.

Figure 12A:
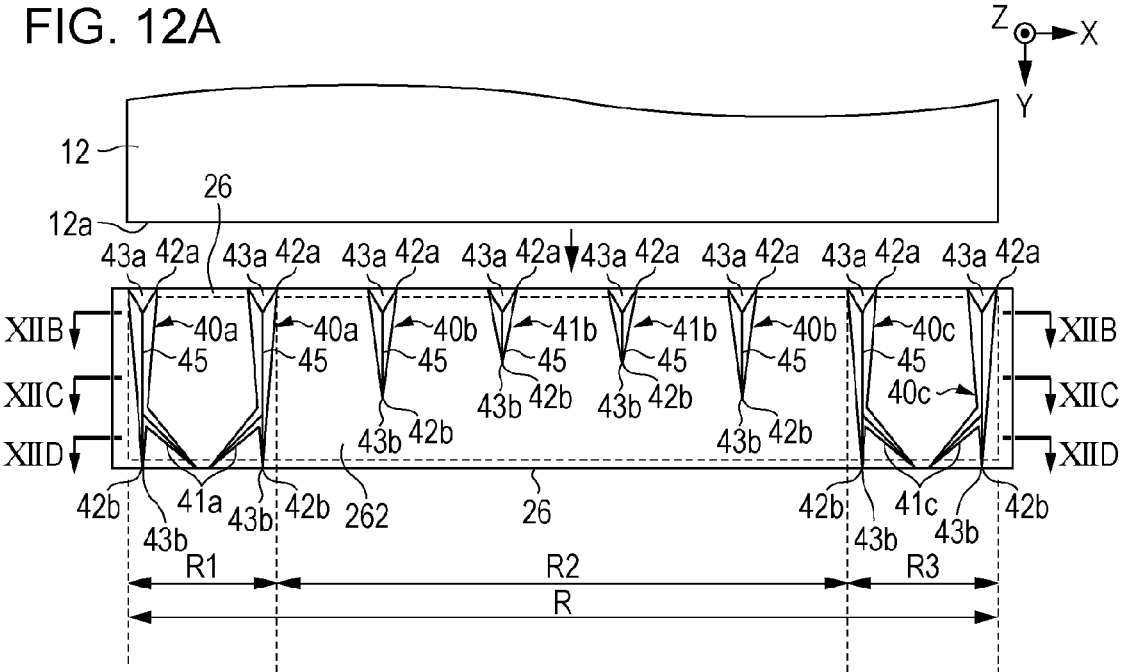
FIGS. 12A to 12D are plan views illustrating another configuration example of the ejection surface of the liquid ejecting head configured in accordance with the curling characteristics of the medium.
Figure 12B:
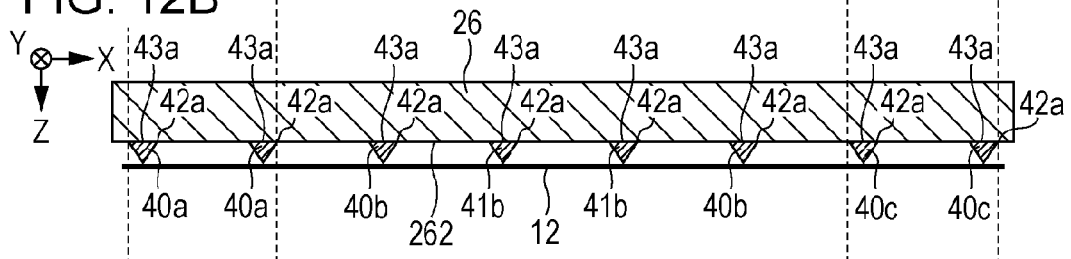
Figure 12C:
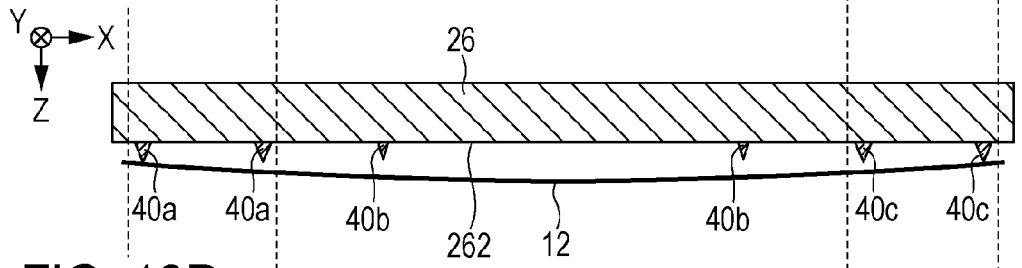
Figure 12D:
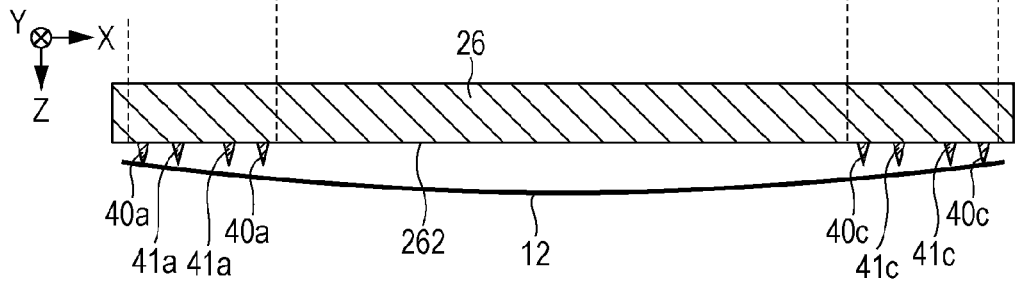

Next, as another configuration example of the liquid ejecting head 26 configured in accordance with the curling characteristics of the medium 12, a case where the disposition density of the projection portion changes from the upstream side to the downstream side in the transporting direction will be described. FIGS. 12A to 12D are views illustrating the ejection surface 262 of the liquid ejecting head 26 configured in accordance with the curling characteristics of the medium 12. FIG. 12A is a plan view when viewed from the negative Z direction side. FIG. 12B is a sectional view taken along line XIIB-XIIB. FIG. 12C is a sectional view taken along line XIIC-XIIC. FIG. 12D is a sectional view taken along line XIID-XIID. FIGS. 12A to 12D illustrate the change in the height of the projection portions 40 from the upstream side to the downstream side. In addition, in FIGS. 12A to 12D, similar to FIGS. 11A to 11D, to make it easy to understand, configuration members, such as the nozzles N, other than the projection portion 40, will be omitted.

Even on the ejection surface 262 illustrated in FIGS. 12A to 12D, similar to FIGS. 11A to 11D, the nozzle arrangement region R of the ejection surface 262 is divided into the first region R1, the second region R2, and the third region R3 so that a ratio of the lengths of the first region R1, the second region R2, and the third region R3 becomes 1:2:1, for example. In the first region R1 which is one end portion region of the ejection surface 262 illustrated in FIG. 12A, the projection portion 40 which extends from the upstream side to the downstream side in the transporting direction and in which the height is constant from the upstream side to the downstream side, is disposed. Furthermore, a projection portion 41*a* which extends being inclined from the middle of the side surface on one side to the downstream side is linked to the projection portion 40*a*. In this manner, by further disposing the projection portion 41*a* in the projection portion 40*a*, it is possible to make the disposition density of the projection portions on the downstream side larger than that on the upstream side. In addition, here, a case where one projection portion 41*a* is linked to the side surface of the projection portion 40*a* is described as an example, but the invention is not limited thereto, and a plurality of projection portions 41*a* may be linked to the side surface of the projection portion 40*a*. In addition, the linking position may be on the side surface on one side of the projection portion 40*a*, or may be on the side surfaces on both sides. As the number of linking projection portions increases, it is possible to increase the disposition density of the projection portions.

Even in the projection portion 40*c* disposed in the third region R3 which is the other end portion region of the ejection surface 262, projection portions 41*c* which extend being inclined from the middle of the side surface on one side to the downstream side are linked. This is for making a configuration similar to the projection portions 40*a* and 41*a* disposed in the first region R1 in accordance with the curling characteristics of the medium 12 in which both end portions float up as illustrated in FIG. 10. In contrast to this, in the second region R2 which is the center region of the ejection surface 262, the projection portion 40*b* which is shorter than the projection portions 40*a* and 40*c* is disposed. At this time, as illustrated in FIG. 12A, even in the second region R2 which is the center region, by disposing the projection portions 40*a* and 41*b* which have different lengths from each other, the density on the downstream side may change. In FIG. 12A, in the center region (second region R2), two shortest projection portions 41*b* are disposed at the center, and the projection portions 40*b* which are longer than the projection portions 41*b* are disposed on both sides.

In this manner, according to the ejection surface 262 of the liquid ejecting head 26 illustrated in FIG. 12A, on the sectional view taken along line XIIB-XIIB which is close to the upstream side in the transporting direction, all of the projection portions 40*a*, 40*b*, 41*b*, and 40*c* in the first region R1, the second region R2, and the third region R3 are similarly aligned in the X direction as illustrated in FIG. 12B. For this reason, even when the tip end 12*a* of the medium 12 is curled and enters the transporting direction as illustrated in FIG. 8, the tip end 12*a* comes into contact with the end surface 43*a* of the one end portion 42*a* of each of the projection portions 40*a*, 40*b*, 41*b*, and 40*c*. Therefore, it is possible to prevent the medium 12 from coming into contact with the ejection surface 262 without damaging the medium 12. In addition, since the tip end 12*a* of the medium 12 similarly comes into contact with the end surface 43*a* of the one end portion 42*a*, it is possible to prevent the medium 12 from obliquely moving or meandering.

On the sectional surface along XIIC-XIIC in the middle of the transporting direction, the projection portions 41*b* in the center region (second region R2) disappear as illustrated in FIG. 12C, and only the projection portions 40*b* remain. Accordingly, since the disposition density of projection portions of the center region (second region R2) becomes lower than that in a case of FIG. 12B, the disposition density of the projection portions of the end portion region (the first region R1 and the third region R3) becomes relatively higher. Furthermore, on the sectional surface along XIID-XIID which is close to the downstream side in the transporting direction, the projection portions 40*b* of the center region (second region R2) disappear as illustrated in FIG. 12D, and conversely, in the end portion region (the first region R1 and the third region R3), the number of projection portions 40*a* and 40*c* and the number of the projection portions 41*a* and 41*b* which are respectively linked to the projection portions 40*a* and 40*c* increase, and the disposition density becomes higher. Therefore, even when both end portions start to be curled in the direction of width of the medium 12 as illustrated in FIG. 12C, and the curl grows as illustrated in FIG. 12D, it is possible to accurately prevent both end portions in the direction of width of the medium 12 from floating up by the projection portions 40*a*, 40*c*, 41*a*, and 41*c* of the end portion regions. In addition, since the disposition density of the projection portions 40 is low in the center region (second region R2), it is possible to make it difficult for the airflow which is generated as the ink is ejected to remain on the ejection surface 262.

In addition, in FIGS. 11A to 11D, and 12A to 12D, based on the shape (the length, the inclination of the top portion, or the like) of the projection portions 40 disposed in each region, a case where the height and the disposition density of the projection portions 40 of each region is described. However, based on an average value of the height or the disposition density of the plurality of projection portions 40 disposed in each region, the height and the disposition density of the projection portions 40 in each region may change. For example, in a case of the curling characteristics in which both end portions float up more than the center portion in the direction of width of the medium 12 as illustrated in FIG. 10, the projection portions 40 may be disposed so that the average value of the heights of the projection portions 40 disposed in the end portion regions (the first region R1 and the third region R3) is higher than the average value of the heights of the projection portions 40 disposed in the center region (second region R2). In addition, the height of each projection portion 40 in this case becomes higher as the interval between a virtual plane parallel to a surface which opposes the ejection surface 262 of the liquid ejecting head 26 and to which the medium 12 is transported, and the tip end of the projection portion 40 becomes narrower, and the height becomes lower as the interval becomes wider. In doing so, even when the ejection surface 262 is a curved surface, the average value of the heights of the projection portions 40 can be calculated.

In addition, in the liquid ejecting head 26 illustrated in FIGS. 11A to 11D, and 12A to 12D, the projection portions 40 are disposed in accordance with the curling characteristics in which both end portions float up more than the center portion in the direction of width of the medium 12 as illustrated in FIG. 10. However, the disposition of the projection portions 40 is not limited thereto. For example, the projection portions 40 may be disposed in accordance with the curling characteristics in which the center portion floats up more than both end portions in the direction of width of the medium 12 as illustrated in FIG. 9. In this case, for example, the difference in the disposition density of the projection portions 40 between the center region and the end portion regions may be large so that the height of the projection portion 40 of the center region (second region R2) becomes higher than that of the end portion regions (the first region R1 and the third region R3) from the upstream side to the downstream side of the ejection surface 262, or the disposition density becomes higher. Accordingly, it is possible to accurately prevent the center portion from floating up in the direction of width of the medium 12.

In addition, it is also possible to dispose the projection portions 40 in accordance with the curling characteristics in which only one end portion in the direction of width of the medium 12 floats up. In this case, for example, when the end portion regions in which the medium 12 floats up is the first region R1, the difference in the disposition density of the projection portions 40 between the first region R1 and the other regions (the second region R2 and the third region R3) may be increased so that the height or the disposition density of the projection portion 40 of the first region R1 becomes higher than that of the other regions (the second region R2 and the third region R3). In addition, in a case where the end portion regions in which the medium 12 floats up is the third region R3, the difference in the disposition density of the projection portions 40 between the third region R3 and the other regions (the first region R1 and the second region R2) may be increased so that the height or the disposition density or the projection portions 40 of the third region R3 becomes higher than that of the other regions (the first region R1 and the second region R2). In this manner, in the embodiment, the nozzle arrangement region R of the ejection surface 262 is divided into the first region R1, the second region R2, and the third region R3, and it is possible to determine the height and the disposition density of the projection portions 40 of each regions R1, R2, and R3 in accordance with the curling characteristics in the direction of width of the medium 12.

Figure 13:
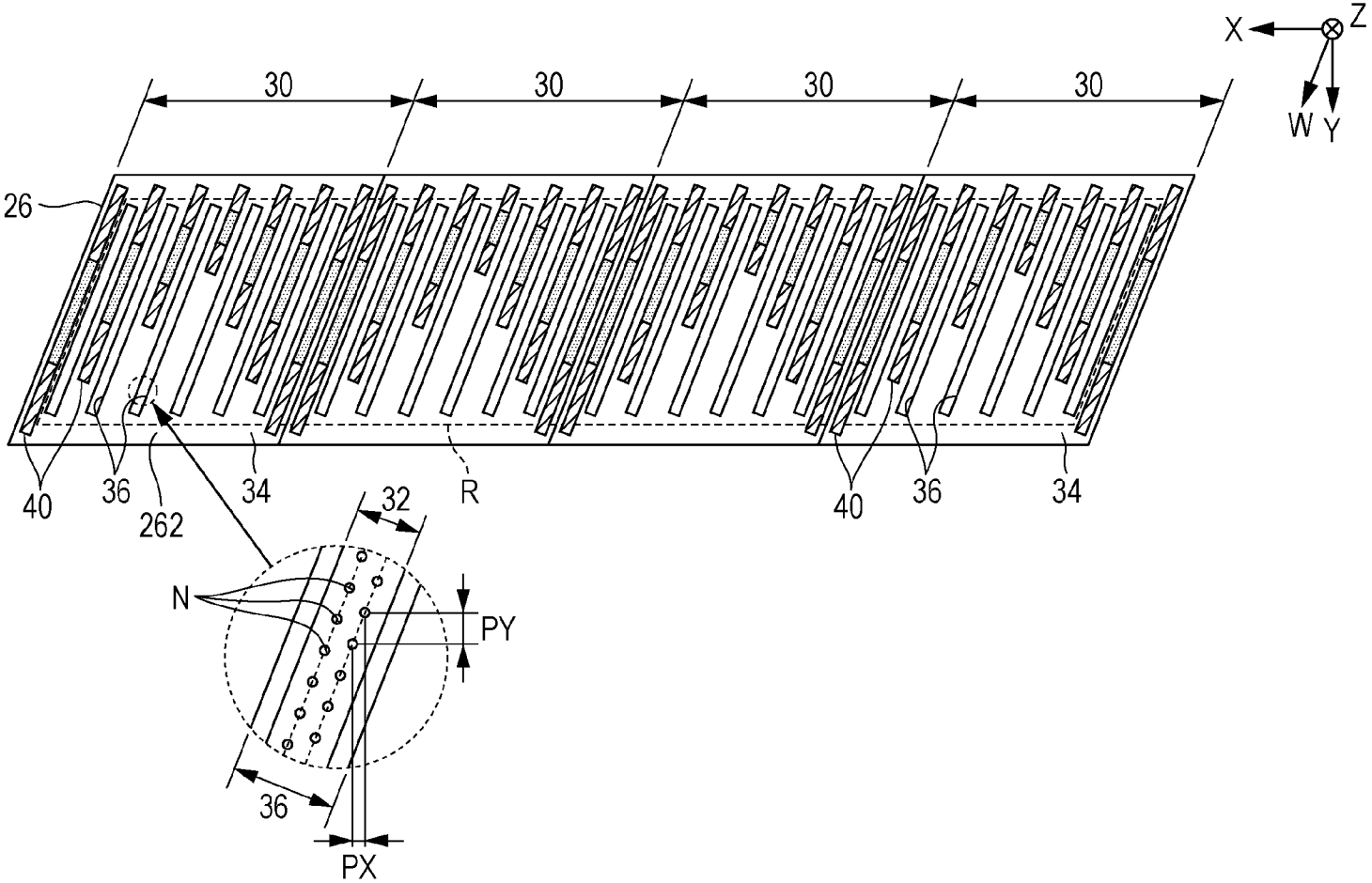
FIG. 13 is a plan view illustrating another configuration example of the ejection surface of the liquid ejecting head, and a case where an opening portion which exposes nozzles is inclined with respect to the transporting direction.

Next, as another configuration example of the liquid ejecting head 26 of the embodiment, a case where the projection portions 40 are disposed in the liquid ejecting heads 26 in which opening portions that expose the nozzles N are obliquely moving with respect to the transporting direction, will be described. FIG. 13 is a view illustrating a configuration example of the ejection surface 262 of the liquid ejecting head 26 according to a third modification example. The liquid ejecting head 26 illustrated in FIG. 13 is a line head which is long in the X direction (first direction), and is configured to be divided into a plurality (here, four) of head portions 30. Each head portion 30 is disposed so as to oppose the medium 12 at a predetermined interval in a state of being parallel to the X-Y plane. The desired image is formed on the front surface of the medium 12 as the liquid ejecting head 26 ejects the ink onto the medium 12 at the same time as the medium 12 is transported by the transporting mechanism 24. In each head portion 30, the plurality of nozzles N which eject the ink supplied from the liquid container 14 are provided. Each head portion 30 is configured as the plurality of liquid ejecting portions (head chips) including the nozzle plate 32 on which the nozzles N are formed are attached to the fixed plate 34.

Specifically, as illustrated in an enlarged view of FIG. 13, the plurality of liquid ejecting portions including the nozzle plate 32 are attached to the fixed plate 34 so that the plurality of opening portions 36 are formed and the nozzles N are exposed from the opening portion 36. Each nozzle N is aligned in two rows along the W direction which intersects with the X direction. The W direction illustrated in FIG. 13 is a direction of being inclined by a predetermined angle (for example, an angle within a range of 30° to 60°) with respect to the X direction and the Y direction within the X-Y plane. The positions of the plurality of nozzles N are selected so that a pitch (specifically, the distance between centers of each nozzle N) PX in the X direction becomes narrower than a pitch PY in the Y direction (PX<PY). As described above, since the plurality of nozzles N are aligned in the W direction which is inclined with respect to the Y direction in which the medium 12 is transported, for example, compared to a configuration in which the plurality of nozzles N are aligned along the X direction, it is possible to increase a practical resolution (dot density) in the X direction of the medium 12.

The projection portions 40 of the liquid ejecting head 26 illustrated in FIG. 13 are provided between each opening portion 36. The projection portion 40 is formed in a long shape (a straight line shape), and extends along the W direction similar to the opening portion 36. Therefore, here, the W direction is the second direction in which the projection portion 40 extends. In this manner, as the projection portion 40 is disposed between each opening portion 36, it is possible to effectively prevent the ink remaining in the opening portion 36 from adhering to the medium 12. Here, each projection portion 40 is disposed so that the length (the entire length) in the W direction varies. In other words, in each head portion 30, the length in the W direction of the projection portion 40 provided at the center is the shortest, and the projection portion 40 which becomes longer as the distance between both sides increases is disposed. The length of the projection portion 40 which is the longest in the W direction is longer than the length of the opening portion 36, and each head portion 30 is disposed so as to be close to both edges. One end portion 42*a* on the upstream side of each projection portion 40 is disposed being gathered at the same position further on the upstream side than the opening portion 36. Accordingly, even when the medium 12 is curled and enters, it is possible to prevent the medium 12 from being damaged. In addition, the projection portion 40 and the fixed plate 34 may be integrally configured, or may be separately configured. Even in the liquid ejecting head 26 which is configured in this manner and illustrated in FIG. 13, similar to the above-described embodiment, it is possible to prevent the medium 12 from coming into contact with the ejection surface 262 by the projection portion 40.

Figure 14:
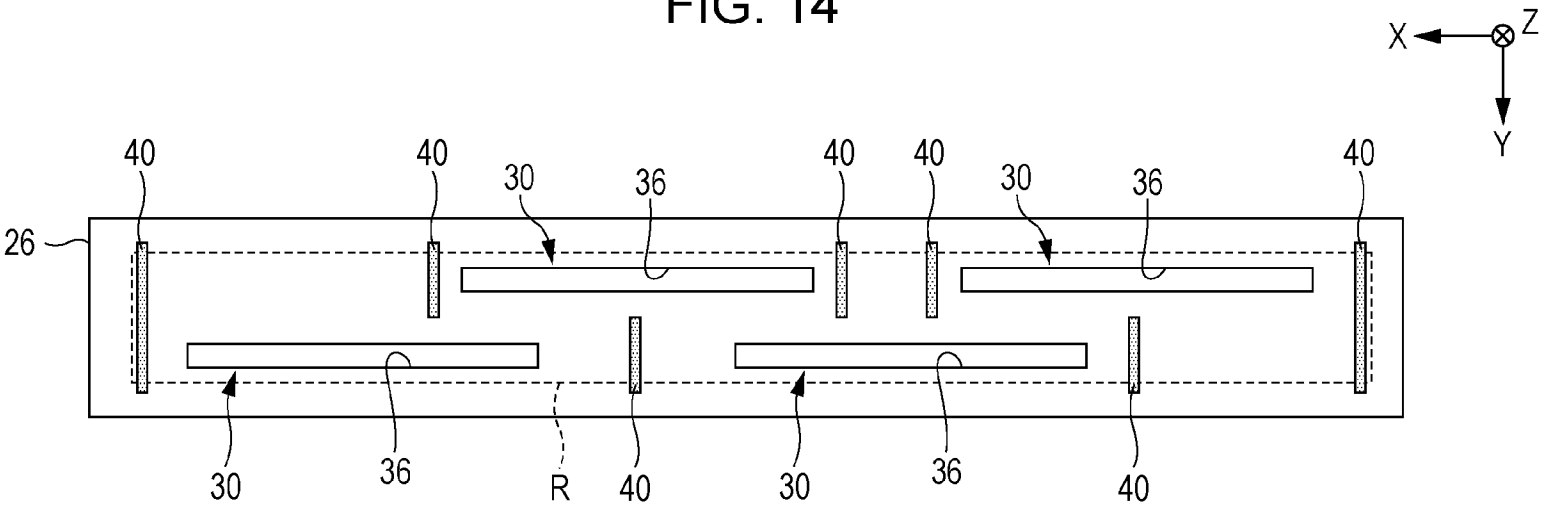
FIG. 14 is a plan view illustrating still another configuration example of the ejection surface of the liquid ejecting head, and a case where the opening portion which exposes the nozzles is orthogonal to the transporting direction.
Figures 15A, 15B, 15C, 15D:
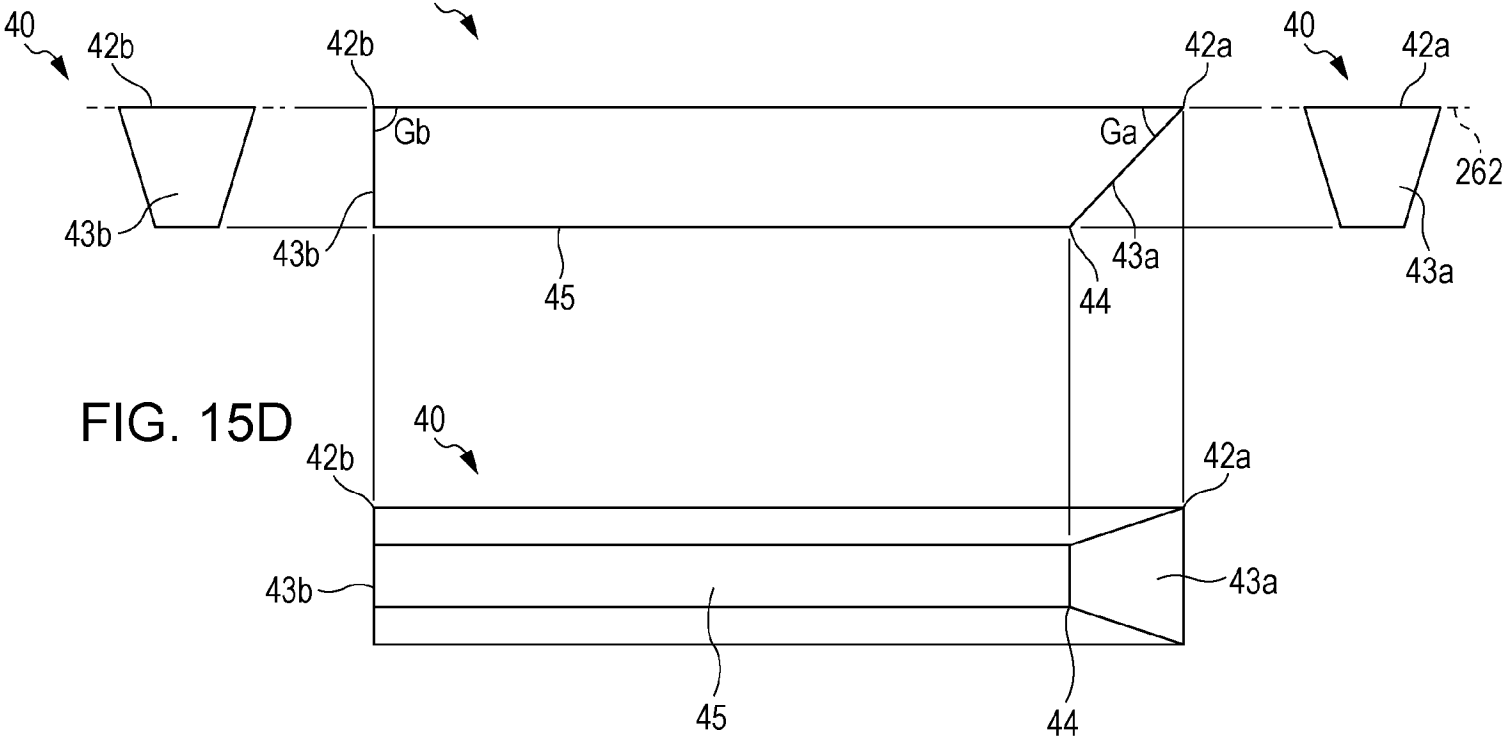
FIGS. 15A to 15D are views illustrating a modification example of the projection portion.
Figures 16A, 16B, 16C, 16D:
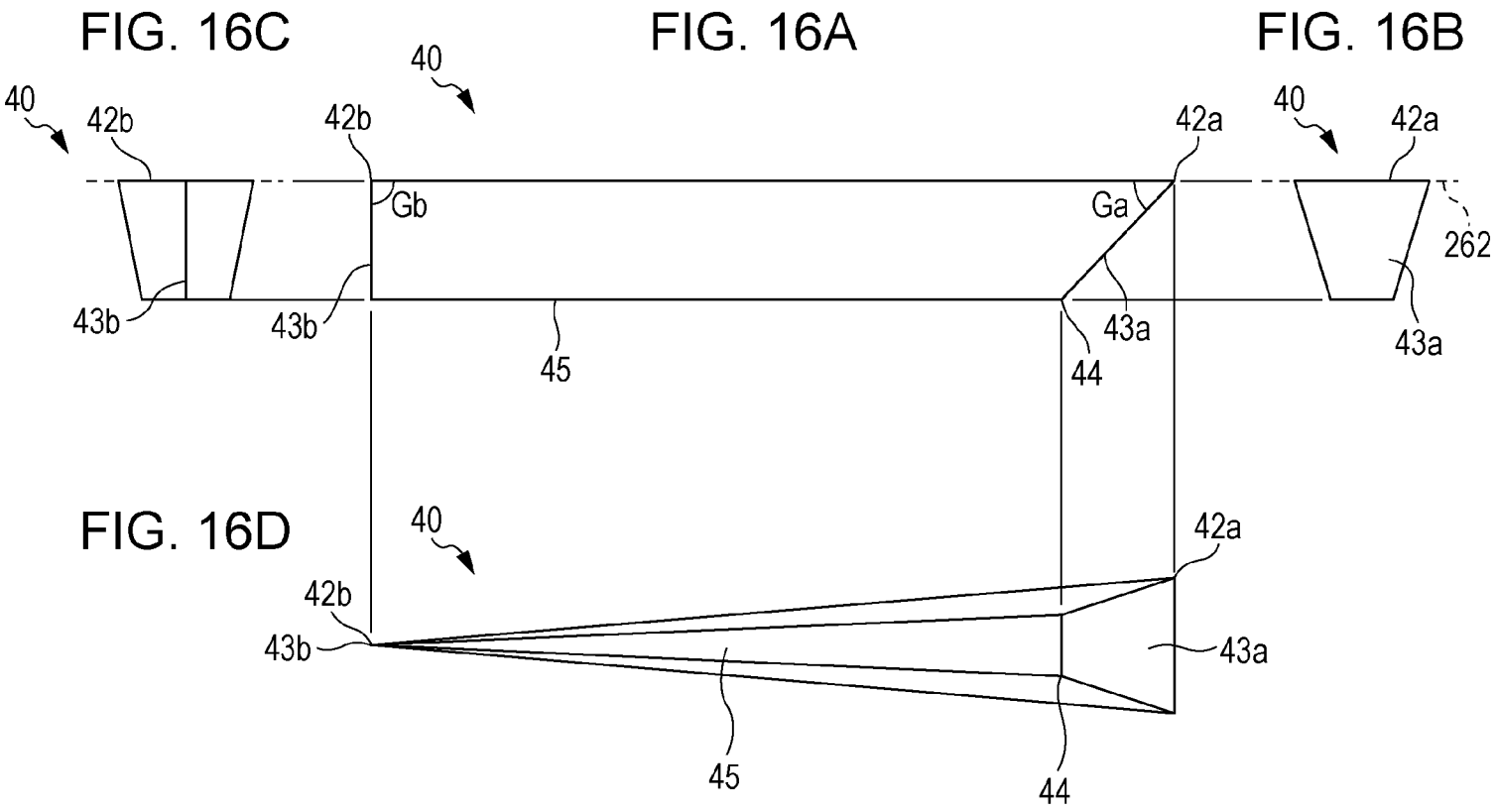
FIGS. 16A to 16D are views illustrating another modification example of the projection portion.

Next, as still another configuration example of the liquid ejecting head 26 of the embodiment, a case where the projection portions 40 are disposed in the liquid ejecting head 26 in which the opening portion 36 that exposes the nozzles N is orthogonal to the transporting direction, will be described. FIG. 14 is a view illustrating a configuration example of the ejection surface 262 of the liquid ejecting head 26 according to a fourth modification example. In the liquid ejecting head 26 illustrated in FIG. 14, the plurality of head portions 30 are aligned (or, disposed so as to be staggered) in a shape of zigzag in the X direction of the ejection surface 262. On the ejection surface 262, in each head portion 30, the plurality of nozzles N which are not illustrated are formed within the X-Y plane.

The projection portions 40 of the liquid ejecting head 26 illustrated in FIG. 14 are provided between each opening portion 36 being parallel to the transporting direction. Therefore, here, the direction (second direction) in which the projection portion 40 extends matches the transporting direction. The projection portions 40 at both ends of the ejection surface 262 are the longest, and the other projection portions 40 are short. In the projection portions 40 which are disposed between the projection portions 40 at both ends of the ejection surface 262 and the opening portion 36 on the upstream side of the ejection surface 262, one end portion 42*a* on the upstream side of each projection portion 40 is disposed being gathered at the same position further on the upstream side than the opening portion 36. Accordingly, even when the medium 12 is curled and enters, it is possible to prevent the medium 12 from being damaged. In addition, the projection portion 40 and the fixed plate 34 may be integrally configured, or may be separately configured. Even in the liquid ejecting head 26 which is configured in this manner and illustrated in FIG. 14, similar to the above-described embodiment, it is possible to prevent the medium 12 from coming into contact with the ejection surface 262 by the projection portion 40.

As described above, according to the embodiment, by providing the projection portion 40 on the ejection surface 262 of the liquid ejecting head 26, even when the medium 12 transported opposing the ejection surface 262 is curled, it is possible to prevent the medium 12 from floating up by the projection portion 40. In this manner, by a simple configuration in which the projection portion 40 is provided on the ejection surface 262, it is possible to prevent the medium 12 from coming into contact with the ejection surface 262. Accordingly, it is possible to prevent the ink remaining on the ejection surface 262 from adhering to the medium 12. In addition, the height of the projection portion 40 includes a part where the height varies from one end side to the other end side, the width of the projection portion 40 becomes narrower from the base side to the tip end side in the direction of height, and further, the shapes of the end portions of the projection portions 40 on one end side and on the other end side are different from each other. According to this, the position, the number, or the area in which the projection portion 40 and the medium 12 come into contact with each other changes from one end side to the other end side. Accordingly, since it is possible to prevent the tip end 12*a* of the medium 12 that comes into contact with the projection portion 40 from being damaged, and to suppress the frictional resistance between the projection portion 40 and the medium 12, it is possible to suppress deterioration of the transporting speed of the medium 12. In addition, since the width of the projection portion 40 becomes narrower from the base side to the tip end side in the direction of height, the space in the direction of height of the projection portion 40 widens, and thus, it is possible to make it difficult for the airflow which is generated as the ink is ejected, such as a vortex, to remain on the ejection surface 262.

In addition, in the above-described embodiment, a configuration in which the projection portions which protrude from the ejection surface of the liquid ejecting head are installed is comprehensively expressed, and the functions or the purpose of the members which form the ejection surface are not considered. As described in the embodiment above, regardless that the ejection surface is formed of the fixed plate or the nozzle plate, various configuration (for example, the shape of the projection portion) illustrated as an example in the above-described embodiment can be similarly employed.

Modification Example

The above-described embodiment can be modified in various manners. Specific modification aspects will be described hereinafter. Two or more aspects which are arbitrary selected from the following examples can be appropriately combined within a range in which the examples do not mutually conflict.

(1) The shape of the projection portion 40 of the liquid ejecting head 26 is not limited to the example of the above-described embodiment. For example, the shape of the sectional surface of the projection portion 40 may be a trapezoid as illustrated in FIGS. 15A to 15D or 16A to 16D. FIGS. 15A to 15D are views illustrating a modification example of the projection portion 40, and illustrating a case where the sectional surface of the projection portion 40 in which the bottom surface is a rectangle, is a trapezoid similar to the example in FIGS. 5A to 5D. FIGS. 16A to 16D are views illustrating another modification example of the projection portion 40, and illustrate a case where the sectional surface of the projection portion 40 in which the bottom surface is a rectangle, is a rectangle similar to the example in FIGS. 7A to 7D. As the projection portions 40 are disposed on the ejection surface 262, it is possible to achieve the effects similar to those of the above-described embodiment.

(2) In the embodiment, the liquid ejecting head 26 configured as a line head is described as an example, but for example, the invention may be employed in a serial head which repeatedly makes a carriage on which the liquid ejecting head is loaded reciprocate along the X direction. In addition, a type of ejecting the ink from the nozzles N may be a type (piezo type) of ejecting the ink by changing pressure of a pressure chamber that penetrates the nozzle N by using a piezoelectric element, or may be a type (thermal type) of ejecting the ink by generating bubbles in the pressure chamber by heating using a heating element, and by changing the pressure in the pressure chamber.

(3) The printing apparatus 10 which is an example in the above-described embodiment can be employed in various machines, such as a facsimile apparatus or a copy machine in addition to the devices dedicated to printing. Furthermore, the purpose of the liquid ejecting apparatus of the invention is not limited to printing. For example, the liquid ejecting apparatus which ejects a solution of coloring materials is used as a manufacturing apparatus which forms a color filter of the liquid crystal display device. In addition, the liquid ejecting apparatus which ejects a solution of conductive materials is used as a manufacturing apparatus which forms a wiring or an electrode of a wiring substrate.

What is claimed is:

1. A liquid ejecting head comprising:

an ejection surface along which a plurality of nozzles that eject liquid are arranged in a first direction; and a projection portion which has a long shape in a second direction that intersects with the first direction on the ejection surface, and protrudes toward a side to which the liquid is emitted from the ejection surface, wherein the projection portion includes a part in which the height varies from one end side to the other end side in the second direction, wherein the width of the projection portion becomes narrower from a base side to a tip end side in the direction of height, and wherein the shapes of end portions of the projection portions on one end side and the other end side are different from each other in the second direction.

2. The liquid ejecting head according to claim 1, wherein the height of the projection portion gradually becomes higher from one end side to the highest part in the second direction, and is constant from the highest part to the other end side.

3. A liquid ejecting apparatus comprising:

a transporting mechanism which transports a medium in a transporting direction; and the liquid ejecting head according to claim 2 which ejects liquid transported in the transporting direction onto a medium.

4. The liquid ejecting head according to claim 1, wherein the height of the projection portion gradually becomes higher from one end side to the highest part in the second direction, and gradually becomes lower from the highest part to the other end side.

5. A liquid ejecting apparatus comprising:

a transporting mechanism which transports a medium in a transporting direction; and the liquid ejecting head according to claim 4 which ejects liquid transported in the transporting direction onto a medium.

6. The liquid ejecting head according to claim 1, wherein the height of the projection portion gradually becomes higher from one end side to the highest part in the second direction, and gradually becomes higher from the highest part to the other end side.

7. A liquid ejecting apparatus comprising:

a transporting mechanism which transports a medium in a transporting direction; and the liquid ejecting head according to claim 4 which ejects liquid transported in the transporting direction onto a medium.

8. The liquid ejecting head according to claim 1, wherein the projection portion is a triangle when the ejection surface is viewed in plan.

9. A liquid ejecting apparatus comprising:

a transporting mechanism which transports a medium in a transporting direction; and the liquid ejecting head according to claim 8 which ejects liquid transported in the transporting direction onto a medium.

10. The liquid ejecting head according to claim 1, wherein the ejection surface is formed of a fixed plate on which an opening portion that exposes the plurality of nozzles is formed, and wherein the projection portion is formed on the fixed plate.

11. The liquid ejecting head according to claim 10, wherein a plurality of opening portions are formed on the fixed plate, and wherein the projection portion is formed between the adjacent opening portions.

12. A liquid ejecting apparatus comprising:

a transporting mechanism which transports a medium in a transporting direction; and the liquid ejecting head according to claim 1 which ejects liquid transported in the transporting direction onto the medium.

13. A liquid ejecting head comprising:

an ejection surface along which a plurality of nozzles that eject liquid are arranged in a first direction; and a plurality of projection portions which are provided in a long shape along a second direction that intersects with the first direction on the ejection surface, and protrude toward a side to which the liquid is emitted from the ejection surface, wherein the ejection surface is divided into a first region, a second region, and a third region from one end side to the other end side in the first direction, and the projection portions are respectively disposed in the first region to the third region, and wherein a height or a disposition density of the projection portion varies between the second region, and the first region and the third region which are at both ends of the second region.

14. The liquid ejecting head according to claim 13, wherein a difference in the height or a difference in the disposition density of the projection portion gradually becomes larger from one end side to the other end side in the second direction between the second region, and the first region and the third region which are at both ends of the second region.

15. A liquid ejecting apparatus comprising:

a transporting mechanism which transports a medium in a transporting direction; and the liquid ejecting head according to claim 14 which ejects liquid transported in the transporting direction onto a medium.

16. The liquid ejecting head according to claim 13, wherein, on one end side in the second direction, the height or the disposition density of the projection portion is the same for the second region, and the first region and the third region which are at both ends of the second region.

17. A liquid ejecting apparatus comprising:

a transporting mechanism which transports a medium in a transporting direction; and the liquid ejecting head according to claim 16 which ejects liquid transported in the transporting direction onto a medium.

18. The liquid ejecting head according to claim 13, wherein the projection portion includes a part in which the height varies from one end side to the other end side in the second direction, wherein the width of the projection portion becomes narrower from a base side to a tip end side in the direction of height, and wherein the shapes of the end portions of the projection portions on one end side and the other end side are different from each other in the second direction.

19. A liquid ejecting apparatus comprising:

a transporting mechanism which transports a medium in a transporting direction; and the liquid ejecting head according to claim 18 which ejects liquid transported in the transporting direction onto a medium.

20. A liquid ejecting apparatus comprising:

a transporting mechanism which transports a medium in a transporting direction; and the liquid ejecting head according to claim 13 which ejects liquid transported in the transporting direction onto a medium.

* * * * *